US008980037B2

(12) United States Patent
DeLise, Jr.

(10) Patent No.: US 8,980,037 B2
(45) Date of Patent: Mar. 17, 2015

(54) METHOD FOR MANUFACTURING EXTENDED CONTENT BOOKLET LABELS

(75) Inventor: Stephen W. DeLise, Jr., West Islip, NY (US)

(73) Assignee: MiniGraphics, Inc., Hauppauge, NY (US)

( * ) Notice: Subject to any disclaimer, the term of this patent is extended or adjusted under 35 U.S.C. 154(b) by 294 days.

(21) Appl. No.: 13/483,355

(22) Filed: May 30, 2012

(65) Prior Publication Data

US 2013/0319604 A1 Dec. 5, 2013

(51) Int. Cl.

| | |
|---|---|
| ***B31D 1/02*** | (2006.01) |
| ***G09F 3/10*** | (2006.01) |
| ***G09F 3/00*** | (2006.01) |

(52) U.S. Cl.

CPC ..... *B31D 1/021* (2013.01); *G09F 3/10* (2013.01); *G09F 3/0289* (2013.01)

USPC ..... 156/227; 156/267; 156/269

(58) Field of Classification Search

None

See application file for complete search history.

(56) References Cited

U.S. PATENT DOCUMENTS

| | | | |
|---|---|---|---|
| 4,991,878 | A | 2/1991 | Cowan et al. |
| RE34,366 | E | 9/1993 | Instance |
| 5,290,616 | A | 3/1994 | Cowan et al. |
| 5,324,559 | A | 6/1994 | Brombacher |
| 5,588,239 | A | 12/1996 | Anderson |
| 5,685,530 | A | 11/1997 | DeLise |
| 5,813,700 | A | 9/1998 | Vijuk et al. |
| 5,830,550 | A | 11/1998 | Treleaven et al. |
| 5,860,238 | A | 1/1999 | Anderson |
| 6,027,598 | A | 2/2000 | Anderson |
| 6,179,335 | B1 | 1/2001 | DeLise, Jr. |
| 6,213,520 | B1 | 4/2001 | Treleaven et al. |
| 6,432,499 | B1 | 8/2002 | Roth et al. |
| 6,432,500 | B1 | 8/2002 | Jones et al. |
| 6,439,614 | B1 | 8/2002 | Cowan |
| 6,576,315 | B2 | 6/2003 | Treleaven et al. |
| 6,712,398 | B1 | 3/2004 | Fox et al. |
| 6,737,137 | B2 | 5/2004 | Franko, Sr. et al. |
| 6,948,743 | B1 | 9/2005 | Peterson |
| 7,947,351 | B1 | 5/2011 | Cowan |
| 2001/0011821 | A1 | 8/2001 | Lind |
| 2011/0223368 | A1 | 9/2011 | Zietlow et al. |

FOREIGN PATENT DOCUMENTS

| | | |
|---|---|---|
| GB | 2303351 | 2/1997 |

OTHER PUBLICATIONS

International Search Report and Written Opinion from Int'l. Stage PCT Application No. PCT/US2013/070951 dated Apr. 25, 2014.

International Search Report and Written Opinion from International Stage Application No. PCT/US2013/070939.

*Primary Examiner* — Barbara J Musser

(74) *Attorney, Agent, or Firm* — Keusey & Associates, P.C.

(57) ABSTRACT

A method for manufacturing an instructional booklet that folds away from a substrate. A multi-up book is provide having two or more booklets and a waste zone that share a common spine. The waste zone is adhered to a substrate that is larger than the booklets. An overlaminate is applied to secure the multi-up book to the substrate. The area between the booklets and the substrate is devoid of adhesive. Subsequently, the waste zone is die cut and removed along with the overlaminate and substrate leaving completed labels with booklets. The substrate can be adhered to a container without interference from the booklet. The booklet is held closed against the label by the overlaminate which extends beyond the substrate and booklet to adhere directly to the container.

28 Claims, 15 Drawing Sheets

FIG. 2A
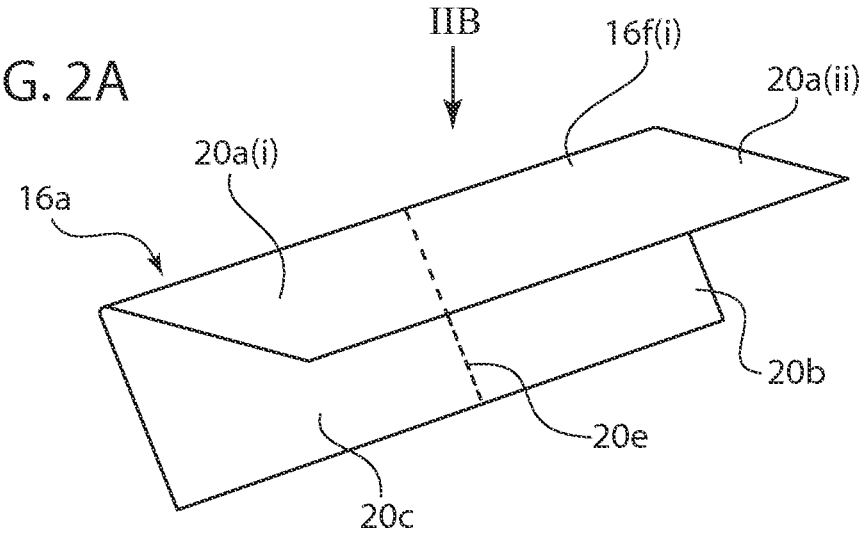
FIG. 2B
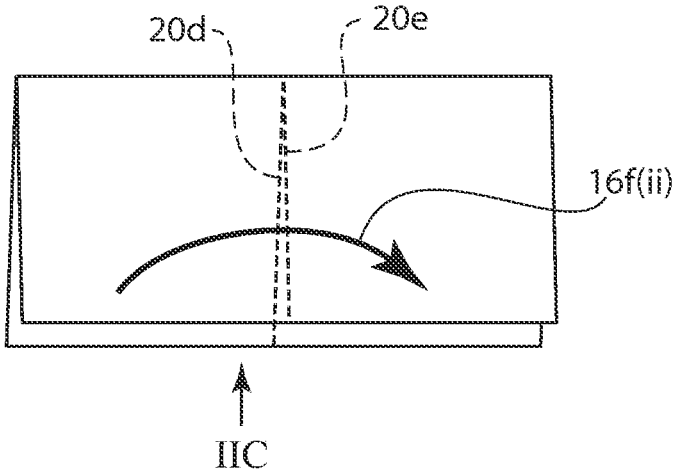
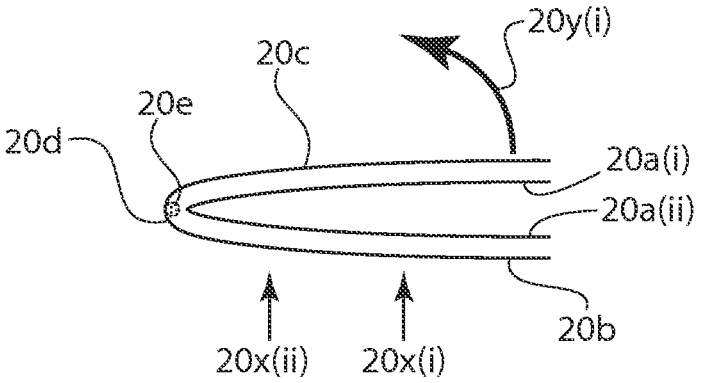
FIG. 2C

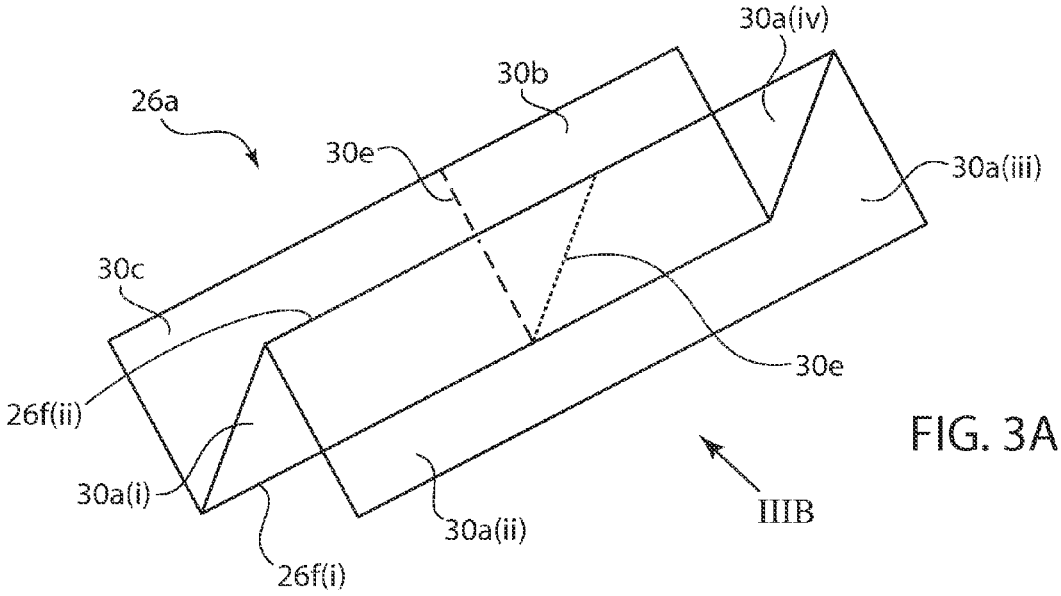
FIG. 3A
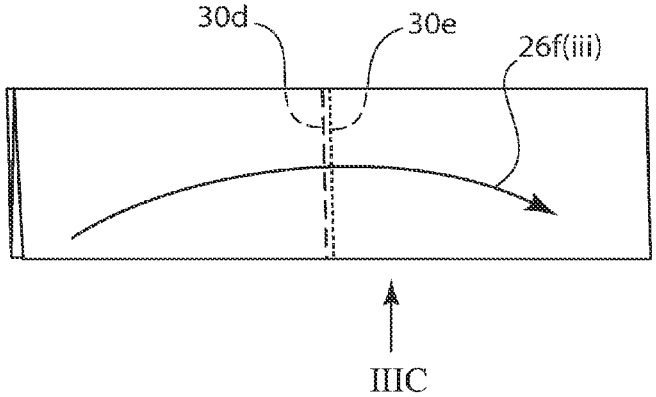
FIG. 3B
FIG. 3C
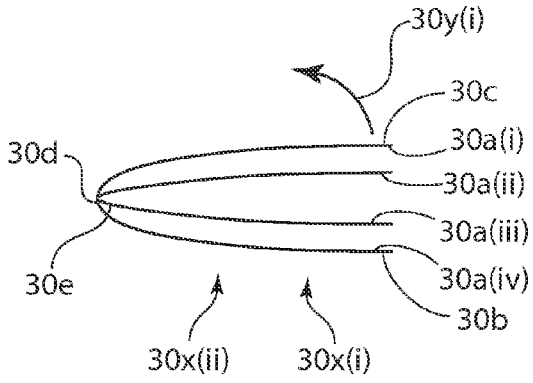

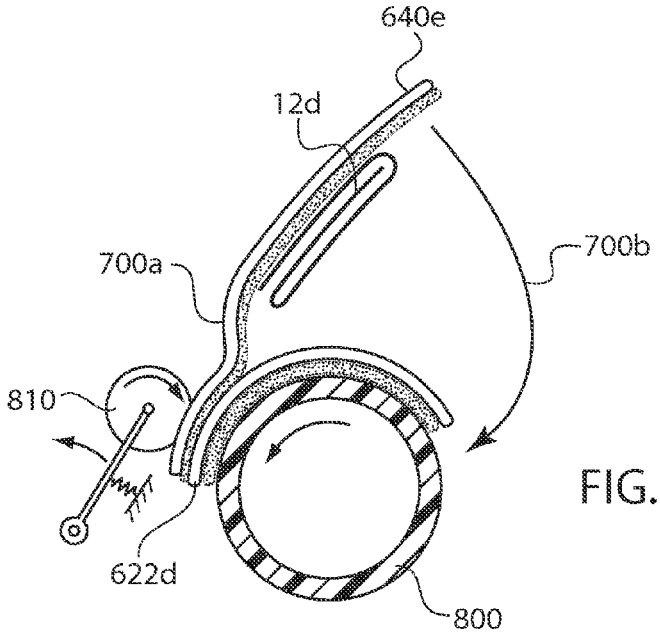
FIG. 11A
FIG. 11B
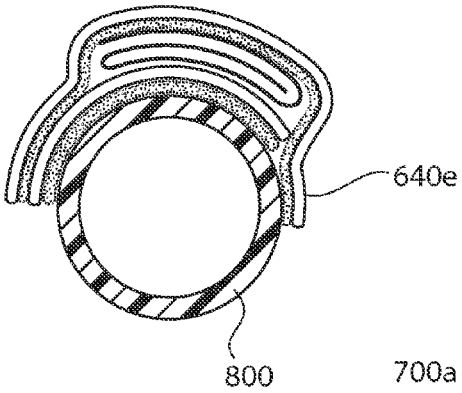
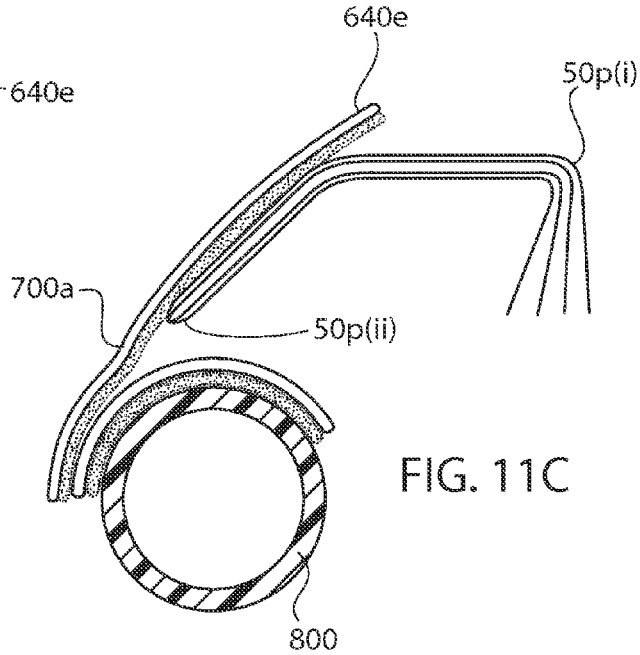
FIG. 11C

METHOD FOR MANUFACTURING EXTENDED CONTENT BOOKLET LABELS

BACKGROUND OF THE INVENTION

1. Field of the Invention

The invention relates to methods for manufacturing extended content booklet labels (ECBL).

2. The Prior Art

Frequently product containers are identified by applying an adhesive-backed label to an outer surface of the container. Such labels retain their product-identifying purpose by remaining permanently affixed to the container.

Certain products which require extensive instructions or which are subject to significant government regulations require additional printed matter which is typically inserted into the product container. In the case of pharmaceuticals, the printed matter may be in the form of printed sheets, printed inserts, or printed outserts. An example of such may be seen in U.S. Pat. No. 5,685,530. While these various forms of printed matter have the benefit of providing a relatively large amount of information, their overall effectiveness is limited if they become separated from the product container.

U.S. Pat. No. 5,830,550 entitled Booklets and Self Adhesive Labels Including the Same shows single labels and multi-up booklets adhered to a continuous web. A label product including a release liner having an upper surface and a booklet disposed on the upper surface of the release liner. The booklet includes an outer piece including a top panel and a bottom panel joined by an outer fold, an inner piece disposed between the top and bottom panels having a pair of interior panels joined by an inner fold, attaching means coupling the outer and inner pieces to one another at the outer and inner folds, and a tear line formed in the bottom panel adjacent the outer fold. A layer of adhesive is interposed between the bottom panel and the upper surface of the release liner.

U.S. Pat. No. 6,576,315 entitled Multi-Ply Resealable Label shows booklets with windows adhered to a continuous web. A label includes a base label having upper and lower opposed surfaces and first and second opposed ends. A base adhesive coats the lower surface of the base label. A top panel overlies the upper surface of the base label and is joined to the base label adjacent the first end. The top panel has an upper surface. A tab having upper and lower opposed surfaces overlies the upper surface of the base label. An adhesive patch is interposed between the base label and the tab adjacent the second end. The adhesive patch secures the lower surface of the tab to the upper surface of the base label. A laminate cover overlies the top panel and the tab. A laminate adhesive secures the laminate cover to the upper surface of the top panel and releasably joins the laminate cover to the upper surface of the tab.

U.S. Pat. No. 6,432,500 entitled Label with Booklet shows a label with an overlaminate that extends beyond the label perimeter. A label with booklet comprises a liner material and a label having an upper and lower surface located on the liner. The label is secured to the liner by an adhesive layer on its lower surface such that the label can be peeled off the liner with the adhesive remaining on the lower surface of the label. A booklet is affixed to the upper surface of the label and comprises a plurality of stacked pages having edges including a top page and a bottom page, each of the pages being coextensive with each other and of smaller dimensions than the label. The booklet further comprises a cover member entirely covering the top page and extending beyond at least two opposing edges of the top page, the cover member having an upper non-adhesive surface, and a lower surface having an adhesive thereon by means of which the lower surface of the cover member is permanently adhered to the upper surface of the top page. The booklet is completely removable from the label by removing at least a portion of the cover member.

U.S. Pat. No. 6,432,499 entitled Nested Label shows a label with die cut windows applied to a release liner. A nested label includes a liner having a surface release, and a label removably bonded to the liner by an adhesive. The liner and label have respective die cuts spaced apart from each other at a skip in the liner release for obtaining different bond strengths between the label and liner on opposite sides of the label die cut.

U.S. Pat. No. 6,948,743 entitled Multilayer Label and Method of Making Same shows multi-page labels with staggered sheets to facilitate application to curved containers. A multiple layer label and a method of making the same are provided. Specifically, a label having a base layer for adhering to a container is provided wherein the label has an overcoat layer having an end that is removably adhered to the container. Moreover, the end that is removably adhered to the container is grasped by a user of the label and pulled, thereby removing the end of the overcoat layer from the container and swinging the layer away from the remainder of the label and exposing sublayers beneath the overcoat layer. The overcoat layer is adhered directly to the base layer, and at least portions of the sublayers. Each of the overcoat layer, sublayers, and the base layer may have indicia printed thereon for communicating information.

U.S. Pat. No. 6,179,335 entitled Product Label Bearing an Instructional Booklet shows a folded booklet adhered to a portion of a label. A two part identifying and instructional booklet having a label part and a booklet part. The front of the label has a small unvarnished region. The booklet is folded and glued closed with the free edges secured interiorly. An adhesive is printed onto the unvarnished region of the label and the folded booklet is adhered to the unvarnished region. The booklet has a tab portion to facilitate opening of the book during use. The tab portion faces the identifying portion of the label which extends longitudinally outwardly from the unvarnished region. The label may be placed onto a cylindrical container and bent in the longitudinal direction whereby the spine and folds of the booklet remain straight, flat and parallel to each other.

U.S. Pat. No. 6,439,614 entitled Nested Leaflet Label Structure shows a booklet adhered to a label. A nested leaflet label structure having an enhanced information carrying capacity. The nested leaflet label structure includes a base panel having a front face. A first leaflet is adjacent to the front face and comprises a first folded panel having a first fold extending substantially parallel to the first axis of the label structure. The first fold divides the first folded panel into a pair of first leaves each having inner and outer page faces. A second leaflet comprises a second folded panel having a second fold extending substantially parallel to the first axis of the label structure. The second fold divides the second folded panel into a pair of second leaves each having inner and outer page faces. A laminating layer overlies the base panel and the first leaflet. The second leaflet is nested in the first leaflet. An assembling adhesive adheres the second leaflet to the first leaflet.

Fold-out labels made from single sheets are shown in U.S. Pat. No. Re. 34,366 and U.S. Pat. No. 5,830,550. An example of a booklet which incorporates certain advantages of a label is disclosed in U.S. Pat. No. 5,324,559. The patent discloses a relatively simple booklet containing four sheets, i.e., eight pages. In all of these patents, the first page contains information which would otherwise be placed on the product label.

The entire back page is adhered to the container leaving only the intermediate pages for instructional information. A further drawback of these patents lies in the fact that if their first page becomes detached from the booklet the product container would be unlabeled. U.S. Pat. No. 6,712,398 shows method for making removable inserts. U.S. Pat. No. 6,737,137 describes a method for manufacturing adhesive image transfer labels.

Accordingly, it would be desirable to provide an identifying and instructional document which combines the permanent nature of an adhesive label with the instructional capacity of a multi-page booklet.

SUMMARY OF THE INVENT ION

Accordingly, it is an object of the present invention to provide compact labels containing large amounts of information.

It is another object to provide methods for economically producing such labels.

It is a further object to provide a multi-up book where several booklet labels can be created across the width of a web.

According to a first embodiment of the invention, there is provided a method for manufacturing (an intermediate product for) an instructional [Extended Content Label (ECL)] booklet (labels) that folds away from a substrate. The first step of the method includes providing a multi-up book (or log) having two or more booklets and a waste zone that share a common spine. Next the waste zone is adhered to a substrate that is larger than the booklets. An overlaminate is applied to secure the multi-up book to the substrate. The area between the booklets and the substrate is devoid of adhesive. In a subsequent step of adhering the label to a container, the substrate and booklet are free to shift and slide with respect to each other and without interference from the other due to the lack of adhesive binding them together.

The adhering step includes printing adhesive on to one of the substrate and multi-up book in a location that only contacts the waste zone when the multi-up book is disposed on to the substrate. Following the applying step, the method further includes simultaneously cutting through the overlaminate, multi-up book and substrate to eliminate the waste zone and form two or more overlaminate panels with each overlaminate panel corresponding to one booklet so that each overlaminate panel hingedly attaches a corresponding booklet to the substrate.

The lack of adhesive between the booklet and the substrate allows the substrate to bend without interference from the booklet. The substrate is a continuous web having a longitudinal feed direction. Prior to the adhering step the method further include removing a strip of substrate to form a leading edge, and registering the multi-up book with the substrate so that a front edge of each booklet is aligned with the leading edge of the substrate. In addition, prior to the adhering step the method includes printing indicia on the substrate in a location remote from the leading edge, and registering the multi-up book with the substrate so that a back edge of each booklet is spaced from the printed indicia.

The substrate includes a top layer including a top surface devoid of adhesive and a bottom surface covered with adhesive, and a bottom layer comprising a release liner. The simultaneous cutting step provides two or more multi-up labels, with each label having a booklet overlaminated to a substrate with adhesive on its bottom surface for securing to a container. The common spine is oriented perpendicular to the longitudinal feed direction. The simultaneous cutting step includes slitting the overlaminate, multi-up book and substrate in a direction parallel to the longitudinal feed direction. The simultaneous cutting step comprises slitting the substrate to intersect the leading edge. The simultaneous cutting step comprises severing at least one of the substrate and overlaminate in a direction perpendicular to the longitudinal feed direction. The simultaneous cutting step comprises severing the back edge of the substrate and overlaminate in a direction perpendicular to the longitudinal feed direction to intersect the longitudinally extending slits. The simultaneous cutting step comprises severing the overlaminate (i) in a location spaced from the leading edge of the substrate and the front edge of the booklet to form an overhanging tab, and (ii) in a direction perpendicular to the longitudinal feed direction to intersect the longitudinally extending slits.

The overlaminate includes a bottom surface covered with adhesive for adhering the multi-up book to the substrate. The overlaminate includes a tab that extends beyond the booklet and substrate adapted to removably adhere to a container. The waste zone is present in between each pair of adjacent booklets. The top edge of the multi-up booklet includes a top waste zone, wherein the top waste zone is adjacent the top booklet. The bottom edge of the multi-up booklet includes a bottom waste zone, wherein the bottom waste zone is adjacent the bottom booklet.

The multi-up book has free ends opposite the spine, wherein the free ends are folded twice over towards spine to enclose the free ends within the book. The free ends are folded over twice to form three approximately equal size panels. Alternatively, the free ends are folded over twice to form three panels of different sizes. The three panels comprise a first panel adjacent the free ends which is centrally located within the multi-up book, a second panel adjacent the spine, and a middle panel extending between the first and second panels. The middle panel is longer than the first panel and shorter than the second panel. The first and middle panels form a ramp up on one side of the multi-up book leading to the central portion of the multi-up book which includes the first, second and middle panels. The second panel forms a ramp down on the other side of the multi-up book leading from the central portion of the multi-up book. The ramp up includes two panels, the central portion includes three panels, and the ramp down includes one panel.

The multi-up book is selected from the group consisting of:

one sheet folded in half to form spine with front cover & back cover (4 pages);

one sheet folded in half, then cross folded to form spine with front & back cover (8 pgs.);

one sheet accordion folded then folded in half to form spine/front/back (12+ pages);

one sheet folded in half with additional pages adhered inside (6+ pages);

multiple sheets folded in half, and nested with spines adhered (8+ pages); and multiple sheets folded in half and stacked with spines adhered (perfect bound (8+ pgs).

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views:

FIGS. 2A-2F are a series of views showing a second embodiment of a multi-up book used in the manufacturing method according to the invention.

FIGS. 3A-3F are a series of views showing a third embodiment of a multi-up book used in the manufacturing method according to the invention.

FIGS. 11A-11C are bottom views of a label adhered to a plastic bottle with the overlaminate in various positions.

DETAILED DESCRIPTION OF THE PREFERRED EMBODIMENTS

Figure 1A:
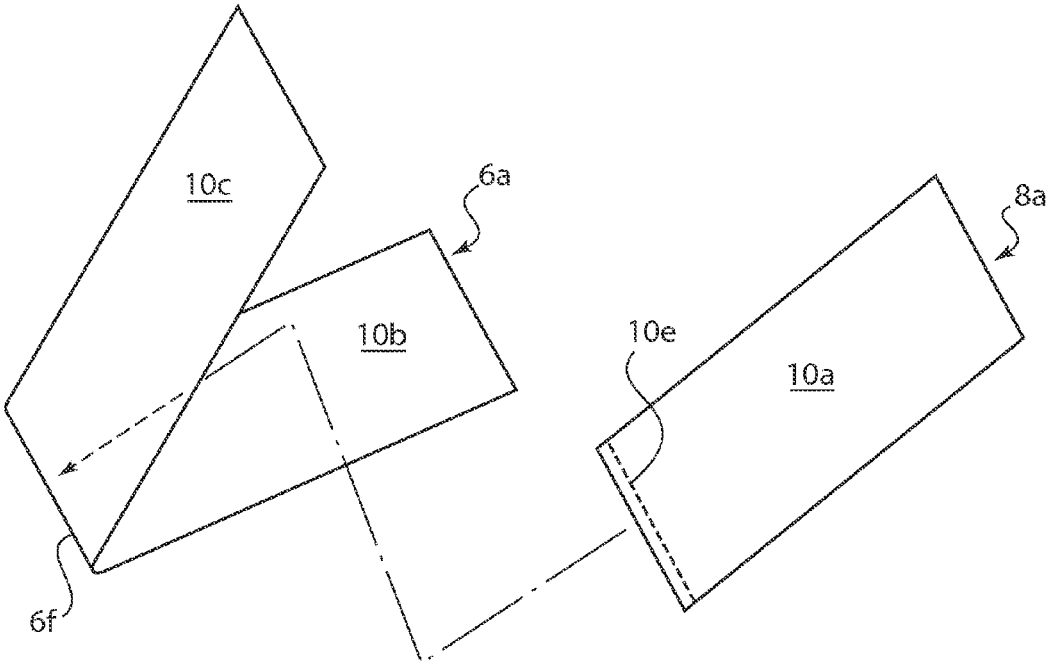
FIGS. 1A-1E are a series of views showing a first embodiment of a multi-up book used in the manufacturing method according to the invention.

In this application a "booklet" means an individual instructional piece having a cover sheet, a back sheet and at least one internal sheet. A sheet is a piece of paper having two opposed pages. The smallest booklet featuring one cover sheet (2 pages), one internal sheet (2 pages) and one back sheet (2 pages) would have a total of six pages. Additional internal sheets can be added. A booklet with two internal sheets would have a total of eight pages.

Booklets may be formed from one large sheet and one medium sheet by folding the large sheet in half and inserting the medium sheet into the fold. Such a booklet would have three sheets for a total of six pages.

The book may be formed by securing sheets and pages together at the binding by adhesive, glue or other suitable connection means. The book may have perforations at various locations on different sheets, to provide pages which can be removed from the book.

Booklets may be formed from one large sheet folded multiple times. The simplest example would be one sheet folded in half, and then folded in half again in a perpendicular direction. Such a booklet would have four sheets for a total of eight pages. The large sheet is bound together at the binding during the first folding step so that when the first fold is trimmed off the sheets remain connected together. Booklets with a greater number of sheets/pages may be provided by folding the large sheet additional times.

Booklets may be formed from two large sheets. The simplest example would be two sheets folded in half and then nested together with their fold lines bound together. Such a booklet would have 4 sheets and eight pages. Each additional large sheet added to the book would contribute another 2 sheets and 4 pages. Alternatively, the two large sheets can be folded in half and stacked together with the fold lines bound together to form a so called perfect bound booklet. Again, each additional large sheet added to the book would contribute another 2 sheets and 4 pages.

Booklets may be formed from large sheets that are folded end-over-end, for example folded end-over-end twice to form a ribbon that is three sheets thick. The ribbon in then folded in half perpendicular to the end-over-end folds. Binding adhesive may not be required. The end-over-end folds are then trimmed off to form a booklet with six sheets and twelve pages. If the original large sheet is folded end-over-end three times, the resulting booklet would have eight sheets and sixteen pages. Accordingly the final number of sheets can be calculated by taking the number of end-over-end folds, adding 1, and multiplying by 2. For 4 end-over-end folds, the resulting booklet would have 10 sheets, i.e. (4+1)*2=10.

Booklets may be formed from large sheets that are accordion folded, for example accordion folded twice to form a ribbon that is three sheets thick. The ribbon in then folded in half perpendicular to the accordion folds. Binding adhesive may not be required. The accordion folds are then trimmed off to form a booklet with six sheets and twelve pages. If the original large sheet is accordion folded three times, the resulting booklet would have eight sheets and sixteen pages. Accordingly the final number of sheets can be calculated by taking the number of accordion folds, adding 1, and multiplying by 2. For 4 accordion folds, the resulting booklet would have 10 sheets, i.e. (4+1)*2=10.

The large or medium sheets used to form the booklets are preprinted with indicia before folding. The layout of the printing is designed to provide text in a particular orientation on each page in the folded booklet. In a preferred embodiment, the indicia includes pharmaceutical information about drugs that are packaged with the booklets. The books can be printed by any suitable industrial printing process, for example sheet offset, web offset, flexographic, rotary letterpress, or gravure.

In this application the term "book" refers to a printed article having two or more booklets included therein. The booklets are linearly arranged with a common spine. In addition, a book includes a waste zone in between each adjacent pair of booklets. A book may include a top waste zone disposed above the top booklet. The top waste zone includes the upper edge of the book. The top waste zone may include free sheets and/or folds. A book may include a bottom waste zone disposed below the bottom booklet. The bottom waste zone includes the lower edge of the book. The bottom waste zone may include free sheets and/or folds. By cutting and removing the waste zone(s), the various booklets will be formed from the book. Cutting a top or bottom waste zone that includes folds, will allow the sheets of the resulting booklets to be opened.

The term "multi-up" refers to the orientation of the booklets within the book when the book is disposed onto the web or substrate. The web is a continuous substrate material that is typically wound off a roll and then passes through various manufacturing stations in a longitudinal direction. Therefore, longitudinal is the direction extending along the indefinite length of the web. The width across the web is a direction that is perpendicular to the longitudinal direction. When the book is placed on the web with the booklets oriented one below the other across the width, the book is considered to be multi-up. That is, a discrete longitudinal section of the web contains two or more booklets.

Figure 1B:
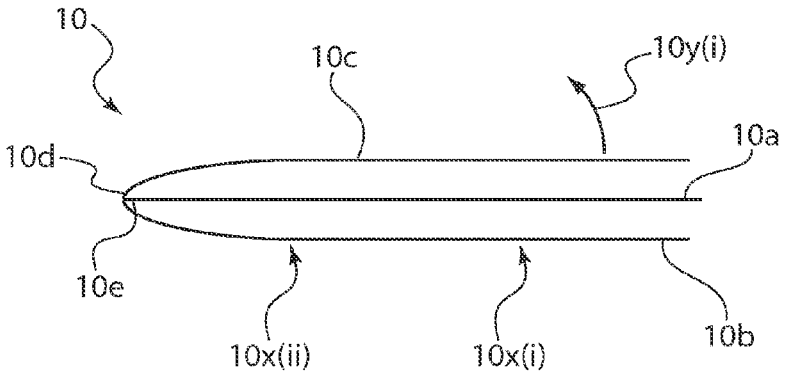

One form of a multi-up book 10 is illustrated in FIGS. 1A-1E. In the drawings, reference numerals having a 6 or 8 prefix, refer to sheets that are used to construct the book. Reference numerals with a 10 prefix refer to the completed book. Reference numerals with a 12 prefix refer to booklets, while reference numerals with a 14 prefix refer to the waste zones. FIG. 1A shows a large sheet 6*a* and a medium sheet 8*a* that are combined to form a book 10. Considering the final configuration of the book, sheets 6 and 8 are pre-printed with indicia to create properly oriented text and images for the various booklets that will be part of the multi-up book. Large sheet 6*a* is folded in half (or twice folded in thirds or additionally folded in other fraction) to form fold 6*f*. Glue 10*e* is applied to secure medium sheet 8*a* to the inside of fold 6*f*. The resulting book 10 is shown in FIG. 1B. The large sheet now forms cover sheet 10*c* and back sheet 10*b*. The medium sheet now forms internal sheet 10*a*. The resulting book has six pages: the front of cover sheet 10*c*, the back of cover sheet 10*c*, the front of internal sheet 10*a*, the back of internal sheet 10*a*, the front of back sheet 10*b*, and the back of back sheet 10*b*.

Glue for the spine of the books may be selected from various adhesives used in paper converting or corrugated applications that are approved for use in pharmaceutical packaging. Such adhesive may be water-based synthetic resins, for example, WB8147M available from H.B. Fuller of St. Paul, Minn.

The resulting book can be increased in size by adding sheets (to create two additional pages per sheet). For example, to increase to an 8 page book, large sheet 6*a* can be combined with a further large sheet. The two large sheets can be folded like sheet 6*a* and nested together with a line of glue at the fold line. Alternatively, the two large sheets can be placed on top of each other and glued together at the spine, in a perfect bound arrangement. To further increase the number of sheets, medium sheets can be added to form a 10 page book, for example. In this manner, books with increasing number of [paired] pages can be formed by combining 1, 2, 3 or more large sheets and 1 or more medium sheets. In lieu of two medium sheets, one could simply add a folded large sheet.

Figure 1C:
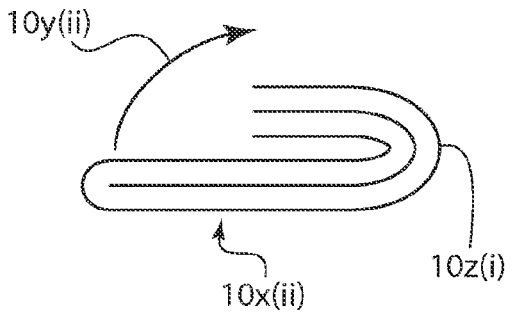
Figure 1D:
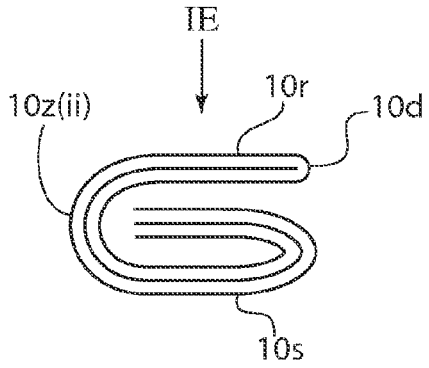

The book shown in FIG. 1B is fully assembled and as a multi-up book (or log) it contains two or booklets, each with a complete set of instructions or indicia. To prepare book 10 for use in the subsequent manufacturing steps, it is desirable to tuck in the free edges to streamline the book for further handling. Book 10 is divided into three sections with two fold locations designated as 10*x*(*i*) and 10*x*(*ii*). The arrow 10*y*(*i*) indicates the fold direction as the book is initially folded at first fold location 10*x*(*i*). FIG. 1C shows the resulting configuration with a completed first fold 10*z*(*i*). The arrow 10*y*(*ii*) indicates the fold direction as the book is subsequently folded at second fold location 10*x*(*ii*). FIG. 1D shows the resulting configuration with a completed second fold 10*z*(*ii*). Note the free ends of the sheets are tucked inside the book so as to avoid interference with the processing and handling equipment. As will be explained in greater detail below, the folded book 10 includes an upper surface 10*r* that will be adhered to the overlaminate, and a lower surface 10*s* that will be placed on the web and selectively adhered thereto.

Figure 1E:
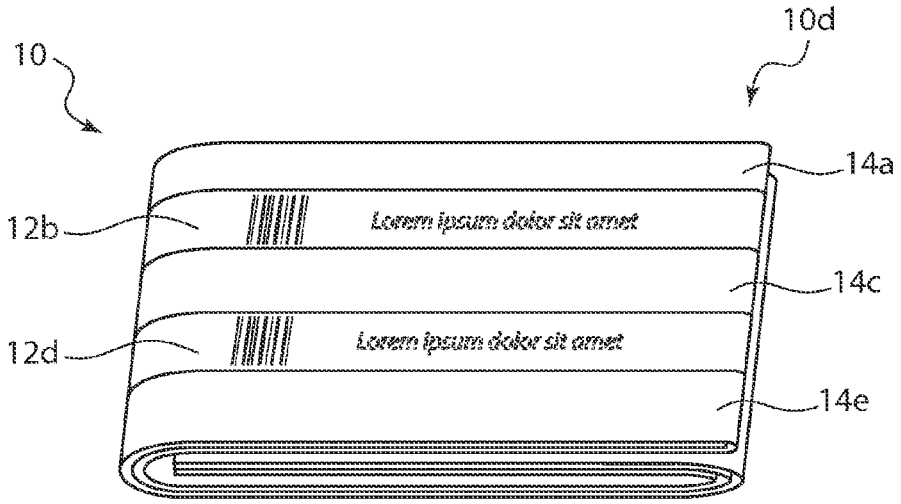

Referring to a top view of the folded book, FIG. 1E shows book 10 with two booklets 12*b*, 12*d* alternating with a top waste zone 14*a*, a waste zone 14*c* and a bottom waste zone 14*e*.

The books are made from paper referred to as offset stock having a paper weight between 22# and 60#. The # designation is a measure of paper density measured in pounds per basis ream of 500 sheets of 17" by 22" paper. Such paper may be obtained from Twin Rivers Paper Company of South Portland, Me. or Finch Paper, LLC of Glen Falls, N.Y. For example Twin Rivers supplies 22# Custom Plus and 27#, 30#, 35#, 40# Pharmopaque—Regular Finish. Finch supplies 40# Finch Opaque—Wove Finish and 60# Finch Opaque—Vellum Finish. The preferred paper is Twin Rivers 27# Pharmopaque—Regular Finish.

Figure 2D:
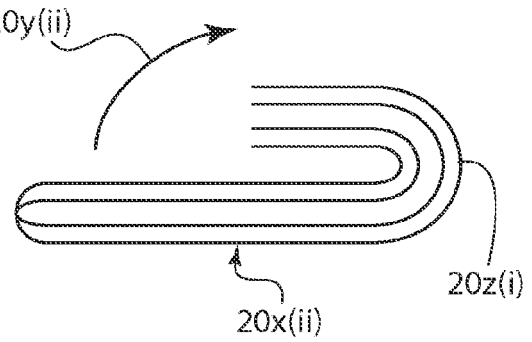

Another form of a multi-up book 20 having 4 sheets and 8 pages made from a single large sheet 16 is shown in FIGS. 2A-2F. In these drawings, reference numerals having a 16 prefix, refer to sheet(s) that are used to construct the book. Reference numerals with a 20 prefix refer to the completed book. Reference numerals with a 22 prefix refer to booklets, while reference numerals with a 24 prefix refer to the waste zones. FIG. 2A shows a large sheet 16*a* pre-printed with indicia to create properly oriented text and images for the various booklets that will be part of the multi-up book. Large sheet 16*a* is folded in half to form fold 16*f*(*i*). Glue 20*e* is applied to secure two linear sections of the folded sheet 16*a* together. As can be most easily seen in FIGS. 2B and 2C, the glue line 20*e* will form the spine 20*d* of the book. The sheet is then folded in half again as indicated by arrow 16*f*(*ii*). When the two folds are completed, the large sheet 16*a* forms cover sheet 20*c*, internal sheets 20*a*(*i*) and 20*a*(*ii*), and back sheet 20*b*. The resulting book has eight pages: the front & back of cover sheet 20*c*, the front and & back of internal sheet 20*a*(*i*), the front and back of internal sheet 20*a*(*ii*), and the front and back of back sheet 20*b*.

The resulting book can be increased in size by adding sheets. For example, another one or more large sheet(s) like 16*a* can be folded and nested within large sheet 16*a* and/or laid on top of 16*a*. Using two large sheets like 16*a* would provide a book with 8 sheets and 16 pages. Alternatively, a medium sheet which is half the size of large sheet 16*a* can be tucked into the fold and adhered top and bottom with a pair of glue lines similar to 20*e*. One large sheet and one medium sheet would provide a book with 6 sheets and 12 pages. In this manner, books with increasing number of [paired] pages can be formed by combining 1, 2, 3 or more large sheets and 1 or more medium sheets. In lieu of two medium sheets, one could simply add a folded large sheet.

Figure 2E:
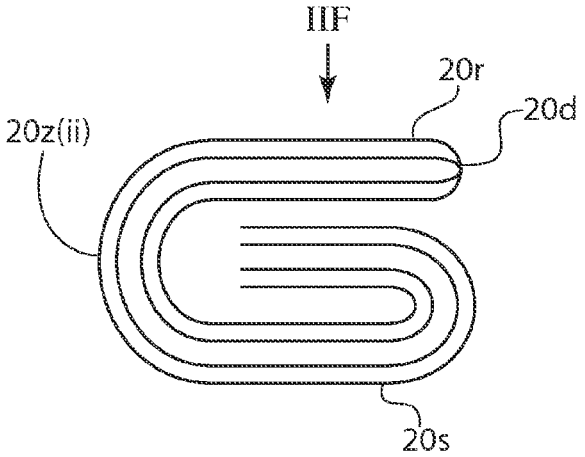

The book shown in FIG. 2C is fully assembled and as a multi-up book it contains two or booklets, each with a complete set of instructions or indicia. In a subsequent step, the top fold 16*f*(*i*) will be trimmed off to allow the pages of book 20 to open and separate from each other. To prepare book 20 for use in the subsequent manufacturing steps, it is desirable to tuck in the free edges to streamline the book for further handling. Book 20 is divided into three sections with two fold locations designated as 20*x*(*i*) and 20*x*(*ii*). The arrow 20*y*(*i*) indicates the fold direction as the book is initially folded at first fold location 20*x*(*i*). FIG. 2D shows the resulting configuration with a completed first fold 20*z*(*i*). The arrow 20*y*(*ii*) indicates the fold direction as the book is subsequently folded at second fold location 20*x*(*ii*), FIG. 2E shows the resulting configuration with a completed second fold 20*z*(*ii*). Note the free ends of the sheets are tucked inside the book so as to avoid interference with the processing and handling equipment. As will be explained in greater detail below, the folded book 20 includes an upper surface 20*r* that will be adhered to the overlaminate, and a lower surface 20*s* that will be placed on the web and selectively adhered thereto.

Figure 2F:
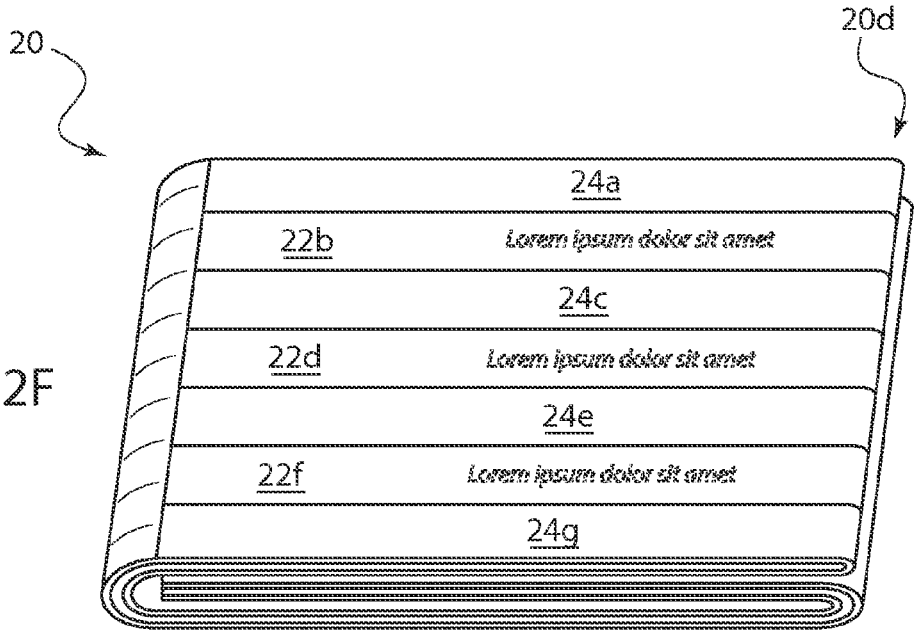

Referring to a top view of the folded book, FIG. 2F shows book 20 with three booklets 22*b*, 22*d*, 22*f* alternating with a top waste zone 24*a*, intermediate waste zones 24*c*, 24*e* and a bottom waste zone 24*g*. As mentioned earlier, top waste zone 24*a* contains fold 16*f*(*i*) and will be trimmed off.

Another form of a multi-up book 30 having 6 sheets and 12 pages made from a single large sheet 26 is shown in FIGS. 3A-2F. In these drawings, reference numerals having a 26 prefix, refer to sheet(s) that are used to construct the book. Reference numerals with a 30 prefix refer to the completed book. Reference numerals with a 32 prefix refer to booklets, while reference numerals with a 34 prefix refer to the waste zones. FIG. 3A shows a large sheet 26*a* pre-printed with indicia, to create properly oriented text and images for the various booklets that will be part of the multi-up book. Large sheet 26 is accordion folded twice in thirds to form folds 26*f*(*i*) and 26*f*(*ii*). Glue 30*e* is applied within both folds. Each glue line secures two linear sections of the accordion folded sheet 26 together. As can be most easily seen in FIGS. 3B and 3C, the glue line 30*e* will form the spine 30*d* of the book. The sheet is then folded in half again as indicated by arrow 26*f*(*iii*). When the three folds are completed, the large sheet 26 forms cover sheet 30*c*, internal sheets 30*a*(*i*) and 30*a*(*ii*) and 30*a* (*iii*) and 30*a*(*iv*), and back sheet 30*b*. The resulting book has twelve pages: the front & back of cover sheet 30*c*, the front and & back of internal sheets 30*a*(*i*) through 30*a*(*iv*), and the front and back of back sheet 30*b*.

The resulting book can be increased in size by adding folds. For example, another one or a larger sheet like 26 can be accordion folded three or more times to produce four or more panels, respectively. That is the total number of folds of form 26*f*(*i*), can be represented by ii, iii, iv . . . n. Where the number of panels would be represented by 3, 4, 5 . . . n+1.

In this manner, books with increasing number of [paired] pages can be formed by an increasing number of accordion folds.

Figure 3D:
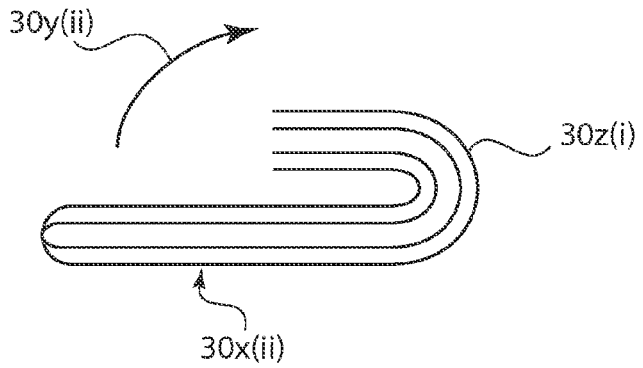
Figure 3E:
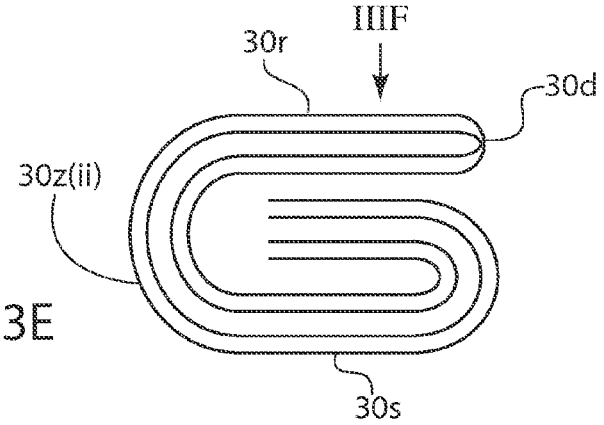

The book shown in FIG. 3C is fully assembled and as a multi-up book it contains two or booklets, each with a complete set of instructions or indicia. In a subsequent step, the top fold 26*f*(*ii*) will be trimmed off to allow the pages of book 30 to open and separate from each other. If additional folds are present along the top edge of book 30, they will likewise be trimmed off. Similarly, the bottom fold 26*f*(*i*) will be trimmed off along with any additional folds present at the bottom edge of book 30. To prepare book 30 for use in the subsequent manufacturing steps, it is desirable to tuck in the free edges to streamline the book for further handling. Book 30 is divided into three sections with two fold locations designated as 30*x* (*i*) and 30*c*(*ii*). The arrow 30*y*(*i*) indicates the fold direction as the book is initially folded at first fold location 30*x*(*i*). FIG. 3D shows the resulting configuration with a completed first fold 30*z*(*i*). The arrow 30*y*(*ii*) indicates the fold direction as the book is subsequently folded at second fold location 30*x* (*ii*). FIG. 3E shows the resulting configuration with a completed second fold 30*z*(*ii*). Note the free ends of the sheets are tucked inside the book so as to avoid interference with the processing and handling equipment. As will be explained in greater detail below, the folded book 30 includes an upper surface 30*r* that will be adhered to the overlaminate, and a lower surface 30*s* that will be placed on the web and be selectively adhered thereto.

Figure 3F:
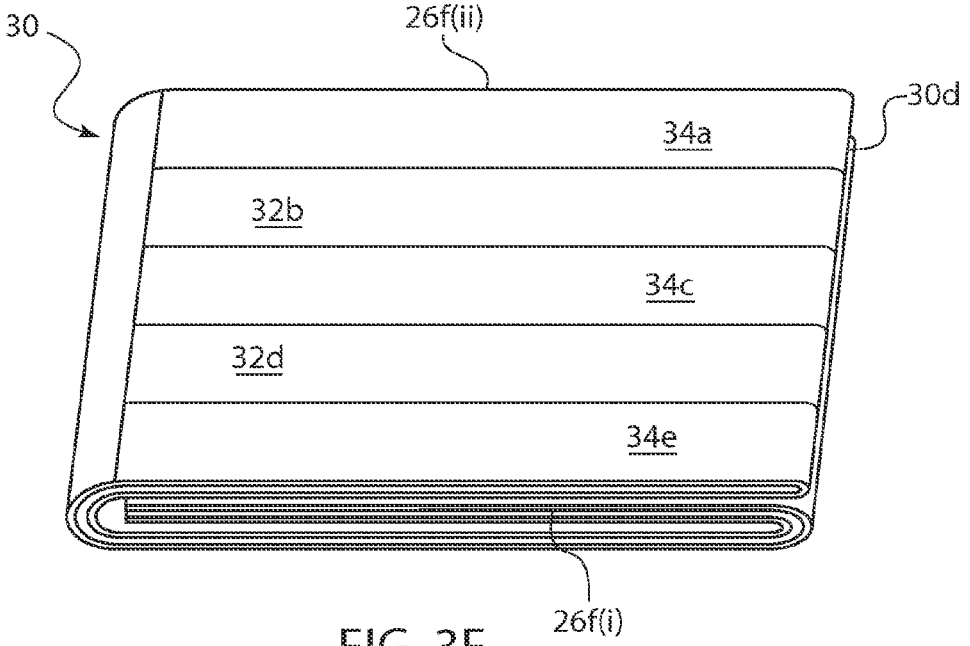

Referring to a top view of the folded book, FIG. 3F shows book 30 with two booklets 32*b*, 32*d* alternating with a top waste zone 34*a*, an intermediate waste zone 34*c*, and a bottom waste zone 34*g*. As mentioned earlier, top waste zone 34*a* contains fold 26*f*(*ii*) and will be trimmed off. Bottom waste zone 34*e* contains fold 26*f*(*i*) and will be trimmed off.

Figure 4A:
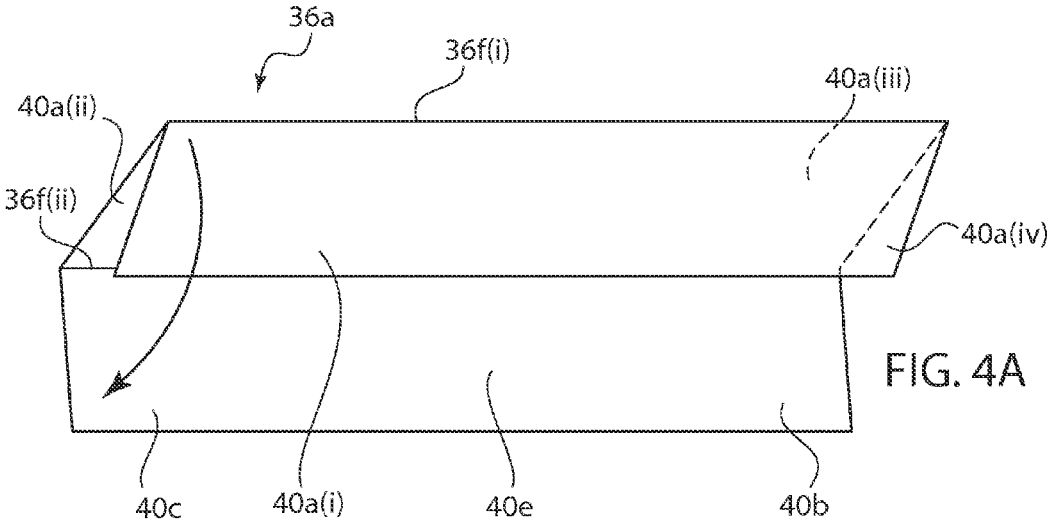
FIGS. 4A-4G are a series of views showing a fourth embodiment of a multi-up book used in the manufacturing method according to the invention.
Figure 4B:
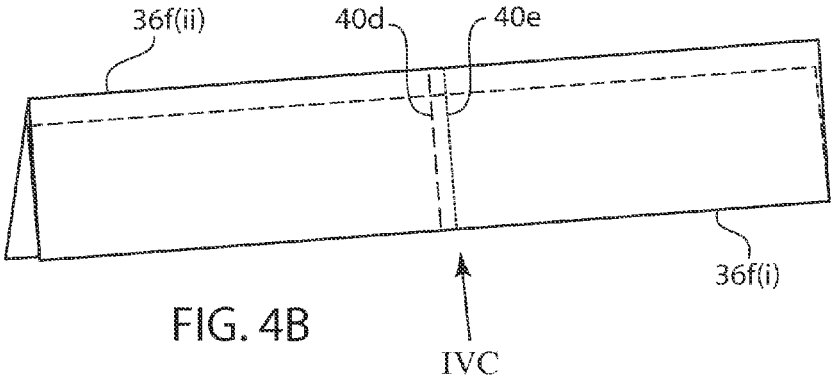
Figure 4C:
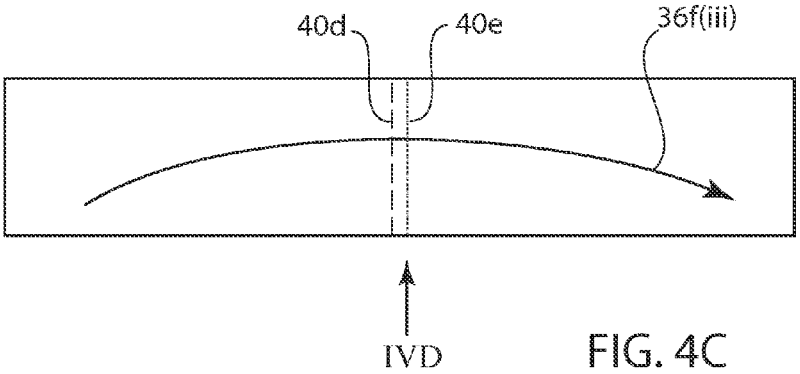

Another form of a multi-up book 40 having 6 sheets and 12 pages made from a single large sheet 36*a* is shown in FIGS. 4A-4G. In these drawings, reference numerals having a 36 prefix, refer to sheet(s) that are used to construct the book. Reference numerals with a 40 prefix refer to the completed book. Reference numerals with a 42 prefix refer to booklets, while reference numerals with a 44 prefix refer to the waste zones. FIG. 4A shows a large sheet 36*a* pre-printed with indicia to create properly oriented text and images for the various booklets that will be part of the multi-up book. Large sheet 36*a* is folded end-over-end twice in thirds to form folds 36*f*(*i*) and 36*f*(*ii*). Glue 40*e* is applied within both folds. For example, glue is applied in a line down the center of large sheet 36*a* perpendicular to the folds 36*f*. The glue line secures two linear sections of the end-over-end folded sheet 36*a* together. As can be most easily seen in FIGS. 4B, 4C and 4D, the glue line 40*e* will form the spine 40*d* of the book. The sheet is then folded in half as indicated by arrow 36*f*(*iii*). Glue line 40*e* is disposed co-linear to the final fold 36*f*(*iii*) which cooperatively form spine 40*d*. When the three folds are completed, the large sheet 26 forms cover sheet 40*c*, internal sheets 40*a*(*i*) and 40*a*(*ii*) and 40*a* (*iii*) and 40*a*(*iv*), and back sheet 40*b*. The resulting book has twelve pages: the front & back of cover sheet 40*c*, the front and & back of internal sheets 40*a*(*i*) through 40*a*(*iv*), and the front and back of back sheet 40*b*.

The resulting book can be increased in size by adding folds. For example, another one or a larger sheet like 36*a* can be folded end-over-end three or more times to produce four or more panels, respectively. That is the total number of folds of form 36*f*(*i*), can be represented by ii, iii, iv . . . n. Where the number of panels can be calculated as a function of folds as ii+1, iii+1, iv+1 resulting in the number of panels being 3, 4, 5 . . . , n+1. In this manner, books with increasing number of [paired] pages can be formed by an increasing number of end-over-end folds.

Figure 4D:
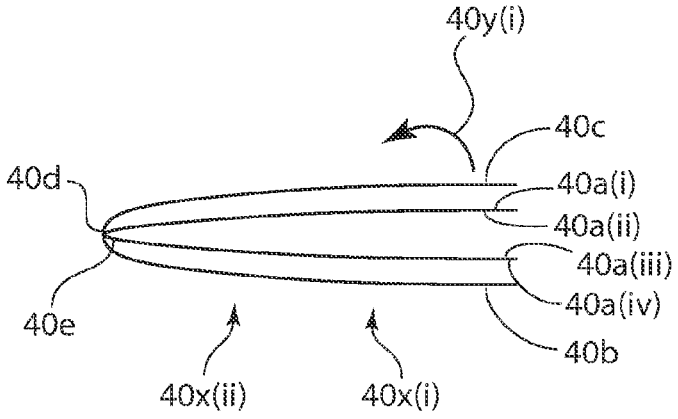
Figure 4E:
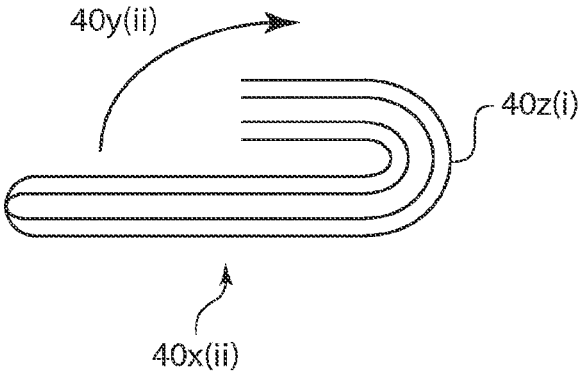
Figure 4F:
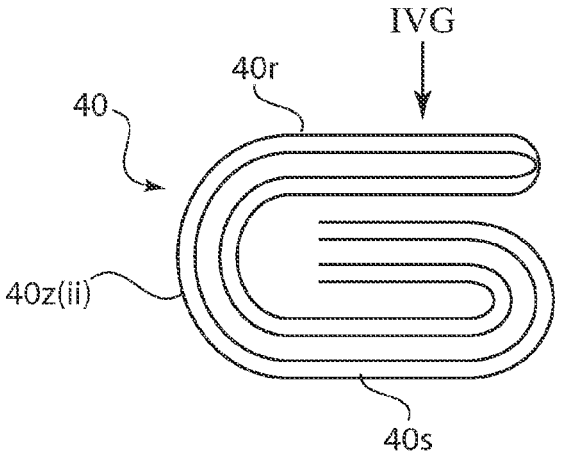

The book shown in FIG. 4D is fully assembled and as a multi-up book it contains two or more booklets, each with a complete set of instructions or indicia. In a subsequent step, the top fold 36*f*(*ii*) will be trimmed off to allow the pages of book 40 to open and separate from each other. If additional folds are present along the top edge of book 40, they will likewise be trimmed off. Similarly, the bottom fold 36*f*(*i*) will be trimmed off along with any additional folds present at the bottom edge of book 30. To prepare book 40 for use in the subsequent manufacturing steps, it is desirable to tuck in the free edges to streamline the book for further handling. Book 40 is divided into three sections with two fold locations designated as 40*x*(*i*) and 40*x*(*ii*). The arrow 40*y*(*i*) indicates the fold direction as the book is initially folded at first fold location 40*x*(*i*). FIG. 4E shows the resulting configuration with a completed first fold 40*z*(*i*). The arrow 40*y*(*ii*) indicates the fold direction as the book is subsequently folded at second fold location 40*x*(*ii*). FIG. 4F shows the resulting configuration with a completed second fold 40*z*(*ii*). Note the free ends of the sheets (which are opposite spine 40*d* as shown in FIG. 4D) are tucked inside the book so as to avoid interference with the processing and handling equipment. As will be explained in greater detail below, the folded book 40 includes an upper surface 40*r* that will be adhered to the overlaminate, and a lower surface 40*s* that will be placed on the web and remain unadhered thereto.

Figure 4G:
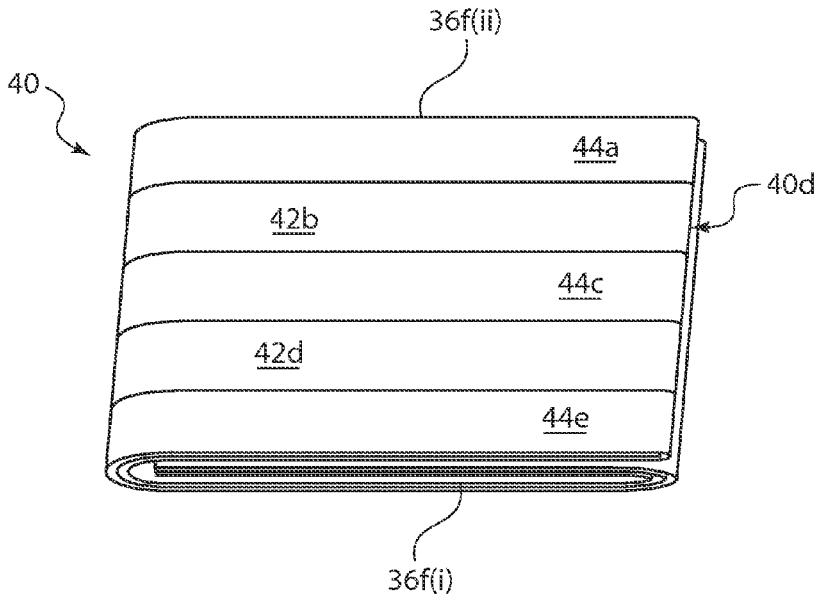

Referring to a top view of the folded book, FIG. 4G shows book 40 with two booklets 42*b*, 42*d* alternating with a top waste zone 44*a*, an intermediate waste zone 44*c*, and a bottom waste zone 44*e*. As mentioned earlier, top waste zone 44*a* contains fold 36*f*(*ii*) and will be trimmed off. If additional top folds are present, they will be trimmed off also. Bottom waste zone 44*e* contains fold 36*f*(*i*) and will be trimmed off. If additional bottom folds are present, they will be trimmed off also.

Figure 5:
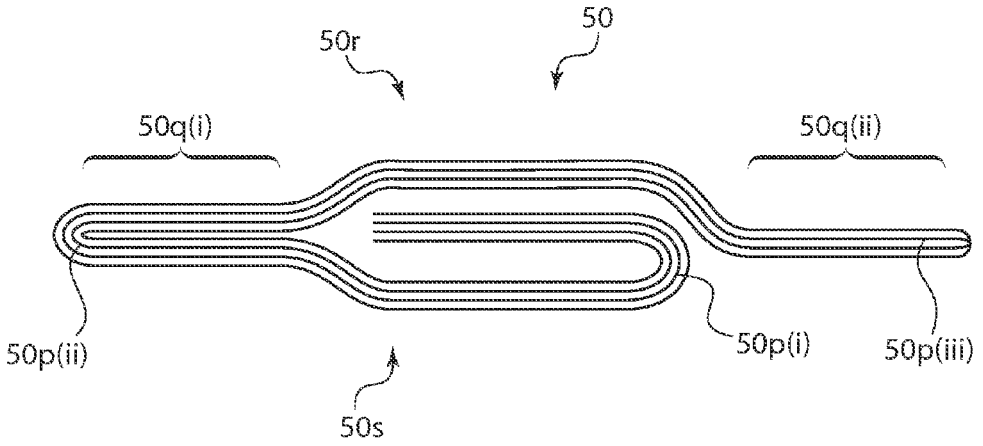
FIG. 5 is a side elevational view showing a fifth embodiment of a folded book used in the manufacturing method according to the invention.

As discussed above, FIG. 4F shows a multi-up book that is bi-folded in equal thirds to form folded book 40. An alternative configuration is shown in FIG. 5, where the multi-up book is twice folded in unequal sections to form folded book 50. Folded book 50 shows a ramp-up section 50*q*(*i*) of double thickness, a center section of triple thickness, and a ramp-down section 50*q*(*ii*) of single thickness. The ramp-up and ramp-down sections are useful in certain applications, for example with thicker books. All of the multi-up books described in this application can be folded to include the ramp-up and/or ramp-down sections. As used herein, a ramp section means a section having fewer than all panels present. The ramp sections are located at the leading or trailing edges of the multi-up book. As will be described in greater detail below, the lower section 50*s* will be placed on the web and remain unadhered, while the upper section 50*r* will be adhered to the overlaminate. The ramp sections will allow the overlaminate to layer onto the book and web with a smoother transition. That is, the overlaminate can transition off the web to a double thickness, before accommodating the triple thickness. The overlaminate can then transition to a single thickness before re-attaching to the web. As can be seen in FIG. 4F, if book 40 is very thick, gaps may form on either side as the overlaminate transitions from the web to triple thickness and then back down to the web.

Referring back to FIG. 5, the upper surface 50*r* will be adhered to the overlaminate, with all other sheets being free from the overlaminate. The book may be formed with perforation, for example, perforations running in the sheets parallel to the spine of the book. When the booklet is opened, perforation 50*p*(*i*) would allow about ⅙ of the sheet to be removed. Such perforations can be included on one or more sheets at similar or different locations. Other perforations 50*p*(*ii*) allow about a half sheet to be removed. Where perforation 50*p*(*iii*) would allow about 1 full sheet to be removed. The sheet portions that are removed could include coupons, receipts for pharmacists, hand-outs for patients, or other printed or machine-scannable documents. Each booklet could have multiple perforations on one sheet, or several perforations on different sheets. The hand-outs could be similar to each other or different. As can be appreciated, the original large sheets 6*a*, 16*a*, 26*a*, 36*a* and the medium sheets 8*a* can be preprinted and perforated to provide indicia and hand-outs in certain orientations and configurations within the individual booklets.

Figure 6:
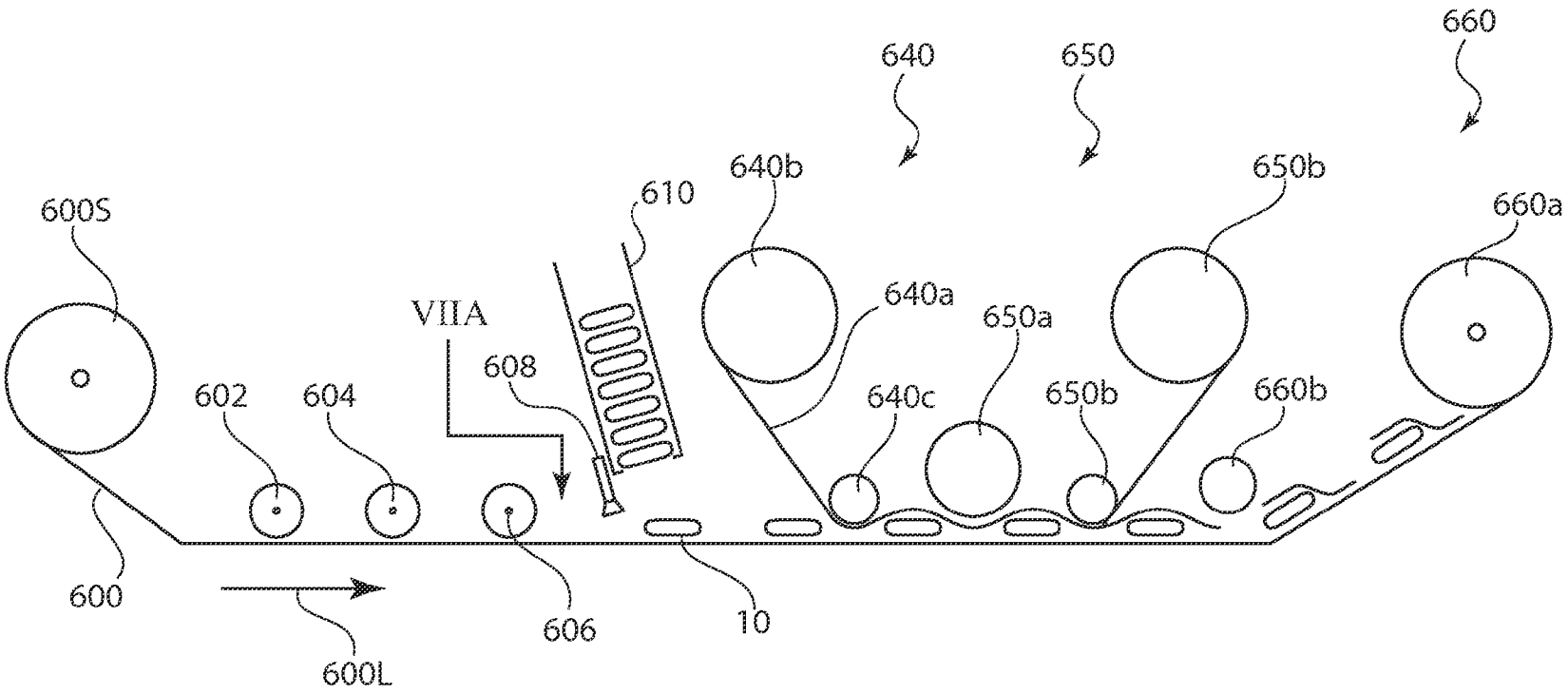
FIG. 6 is a schematic view of an assembly line used to manufacture labels according to the invention.
Figure 7A:
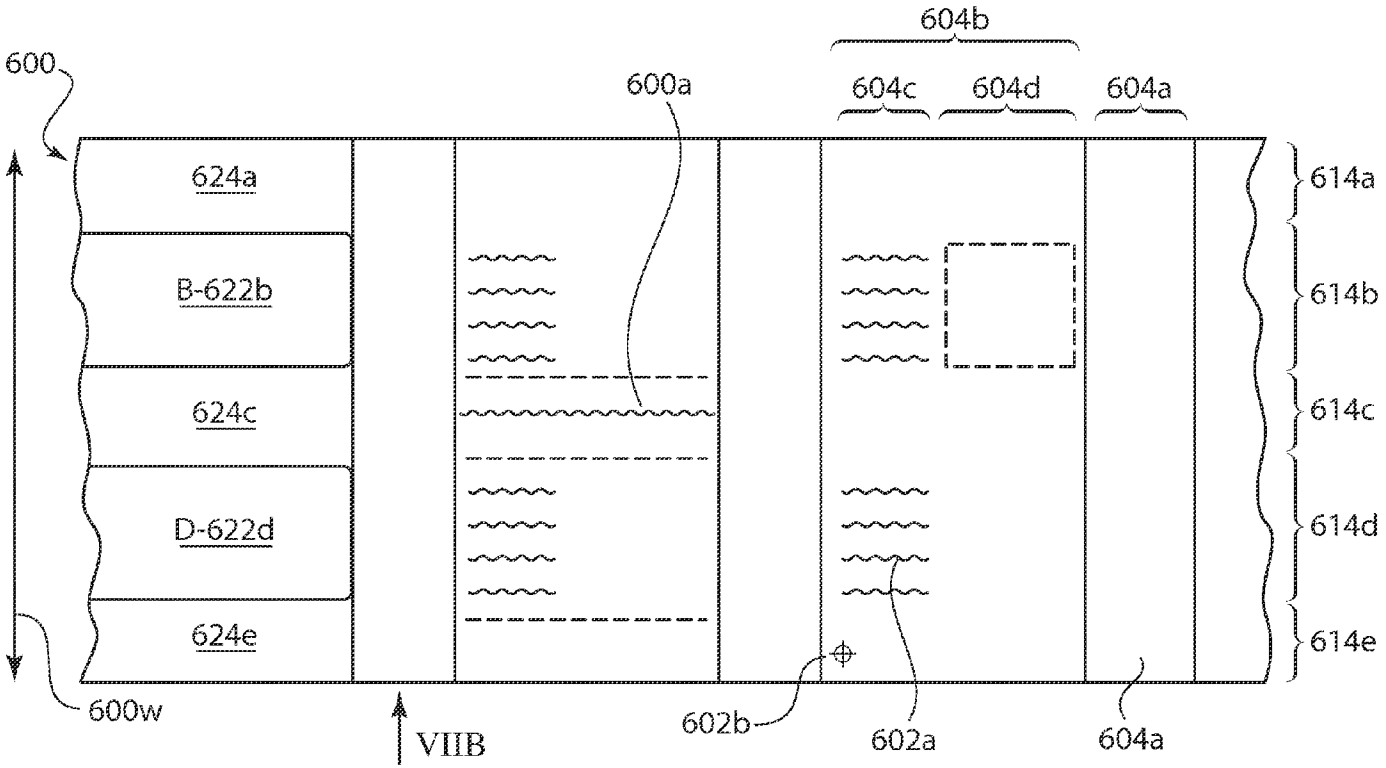
FIGS. 7A and 7B are top and side views of the printed and first die cut web.
Figure 7B:
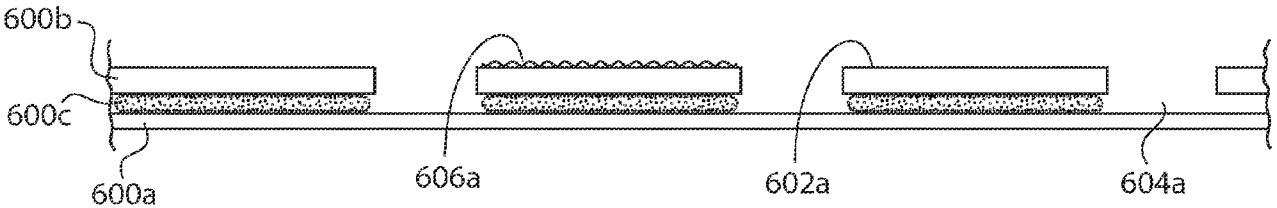

The manufacturing method according to the invention will now be described in reference to the schematic in FIG. 6 which shows a side elevational view of a web 600 traveling off a spool 600*s*, heading toward the right side of the page, through various processing stations. Web travels in a longitudinal direction 600L. The bottom of the web is supported by a conveyor belts or rollers, which are not shown for the sake of clarity. Web may be chosen from various paper or label stock. In a preferred embodiment, web 600 includes a release liner 600*a*, and a paper layer 600*b* coated with adhesive 600*c*, as shown in FIG. 7B. The release liner is a polypropylene substrate having a thickness between 0.5 mil and 4.5 mils.

Suitable labels include those having between 54# to 60# facestock. Such label stock is available from Avery Dennison sold under the trademame Fasson®. For example, Avery Dennison supplies 54# semi-gloss facestock (paper) coated with C2500 rubber based adhesive disposed on 40# bleached, calendered kraft stock liner; and 60# semi-gloss facestock (paper) coated with S246 general purpose permanent rubber based adhesive FDA compliant with 21 CFR 175.105 disposed on 40# bleached, calendered kraft stock liner. The preferred label stock is the latter 60# semi-gloss facestock coated with S246 disposed on 40# stock.

As a broad overview, the web passes through a printing station 602, a first die cutting station 604, an adhesive printing station 606, a sensor 608, a book dispensing station 610, a laminating station 640, a second die cutting station 650 and a web and label take up station 660.

In summary, the web is processed to receive certain printing, first die cutting and adhesive application before reaching the book dispensing station 610. Book dispenser 610 holds a stack of books, for example books 10, 20, 30, or 40 as described above. Books 10 are dispensed one at a time on to moving web 600, with slight spaces between adjacent books. Subsequently, the web carrying the books is processed to receive a laminate, second die cutting, waste laminate removal, and collecting the web-bound completed labels.

Prior to reaching book dispenser 610, web 600 is prepared with printing, die cutting and adhesive application. Printing is achieved via a printing station 602. Web 600 may be printed at an earlier time and then wound on to spool 600*s*. As can be seen in FIG. 7A, printed matter may include indicia 602*a* that will appear on the label to the left of the booklet. Printing may also include a registration mark 602*b* that is read by sensor 608 to control the longitudinal placement of books 10 along the web. That is, the registration mark 602*b* will be placed in a known location with respect to the printing, die cutting and adhesive 600*c* so that the books 10 can be disposed on the web in proper positions.

Die cutting is achieved via a first die cutting station 604. Die cutting may occur before or after printing. Die cutting may occur before or after the web is wound on to spool 600*s*. Die cutting may be performed by a drum having a raised blade or blades which rotates in registration with web 600 to repeatedly cut and remove sections of paper layer 600*b* and its adhesive coating 600*c*. In other words, the diameter of the drum is sized to carry one or more spaced blades which rotate at the same velocity as web 600 to automatically and continuously cut sections of the paper layer 600*b*. In one embodiment, the drum carries three pairs of parallel blades, where each pair cuts a section of web 600 that is removed before further processing. As can be seen in FIGS. 7A and 7B, the resulting web includes cut sections 604*a* where only the release liner 600*a* remains. In between the cut sections are label sections 604*b*. These label sections 604*b* include a printed column 604*c* and a book placement column 604*d*. In a preferred embodiment, printed column 604*c* contains multiple instances of indicia 602*a* that are located in the rows designated by reference numerals 612*b* and 612*d*. Similarly, book placement column 604*d* contains multiple booklet target zones 604*e* that are also located in the rows designated by reference numerals 612*b* and 612*d*.

Label section 604*b* and cut sections 604*a* are arranged in alternating columns that are spaced longitudinally along the web. Waste rows 614 and label rows 612 are arranged in alternating rows spaced along the width of the web. The intersection of booklet placement column 604*d* and label rows (i.e. 612*b* and 612*d*) represent a booklet target zone 604*e*.

Each label section 604*b* has three or more discrete areas that are arranged top to bottom in a direction across the width 600*w* of the web. In a two-up configuration, label section 604*d* includes a B label 622*b* and a D label 622*d* arranged in alternating rows with waste labels. More specifically, there is a top waste label 624*a*, a middle waste label 624*c* and a bottom waste label 624*e*. As will be described more fully below, the booklet waste zones 14*a*, 14*c* and 14*e* will be adhered to the waste labels 624*a*, 624*c* and 624*e* respectively. The booklets 12*b* and 12*d* will overlie B label 622*b* and D label 622*d*, respectively.

Adhesive is applied at adhesive printer 606. While the printing and first die cutting may be provided in either order, both operations are ideally completed before adhesive application. Adhesive may be applied by a rotating drum carrying a printing plate with raised surfaces that will carry adhesive from a source to selected portions of the web. Adhesive may also be sprayed, injected or applied by any suitable means. Adhesive is applied to one or more waste rows 614*a*, 614*c* and/or 614*e*, as indicated by adhesive strip 606*a*. The adhesive may continue or stop across cut columns 604*a*.

Glue used to secure the books to the web may be selected from various adhesives used in paper converting applications that are approved for use in pharmaceutical packaging. Such adhesive may be permanent acrylic adhesive, for example, clear, permanent acrylic adhesive S8020 available from Avery Dennison sold under the tradename Fasson®.

FIGS. 7A and 7B show 3 label sections with various features separated by cut sections 604*a*. The first label section illustrates how the area of the label section is divided into 5 parts to form a two-up label. The label is not physically divided, but rather has sections that are predetermined to serve various functions. The middle label section shows certain of the divisions separated by dotted lines, with an adhesive strip 606*a* applied to the middle waste label 624*c*, and with printing on the adjacent two labels 622*b* and *d*. The right label section shows printed indicia 602*a*, printed registration mark 602*b* and a booklet target zone 604*e*. In summary, all label sections 604*b* have indicia 602*a*, registration mark 602*b* and adhesive strip 606*a* when they are entering the booklet dispenser 610.

Physically, each label section 604*b* has their left and right edges defined by the cut sections 604*a*. Each label section has indicia 602*a* to the left and a registration mark 602*b*. Adhesive 606*a* is disposed in one or more of the waste rows 614*a*, 614*c*, and/or 614*e*.

The web then travels passed sensor 608 before entering book dispenser 610. Books 10 are dispensed to overlie book placement column 604*d*. The width of web 600 can be selected to be approximately the same length of the book spine. Accordingly, the top and bottom edges of book 10 will be aligned with the longitudinal edges of web 600. The sensor 608 detects the location of registration mark 602*b* which is placed in a predetermined location with respect to the leading or trailing edge of each label section 604*b*. Label dispenser 610 uses the sensed data to place book 10 so that its leading edge is in registration with the right side of label section 604*b*.

Figure 8A:
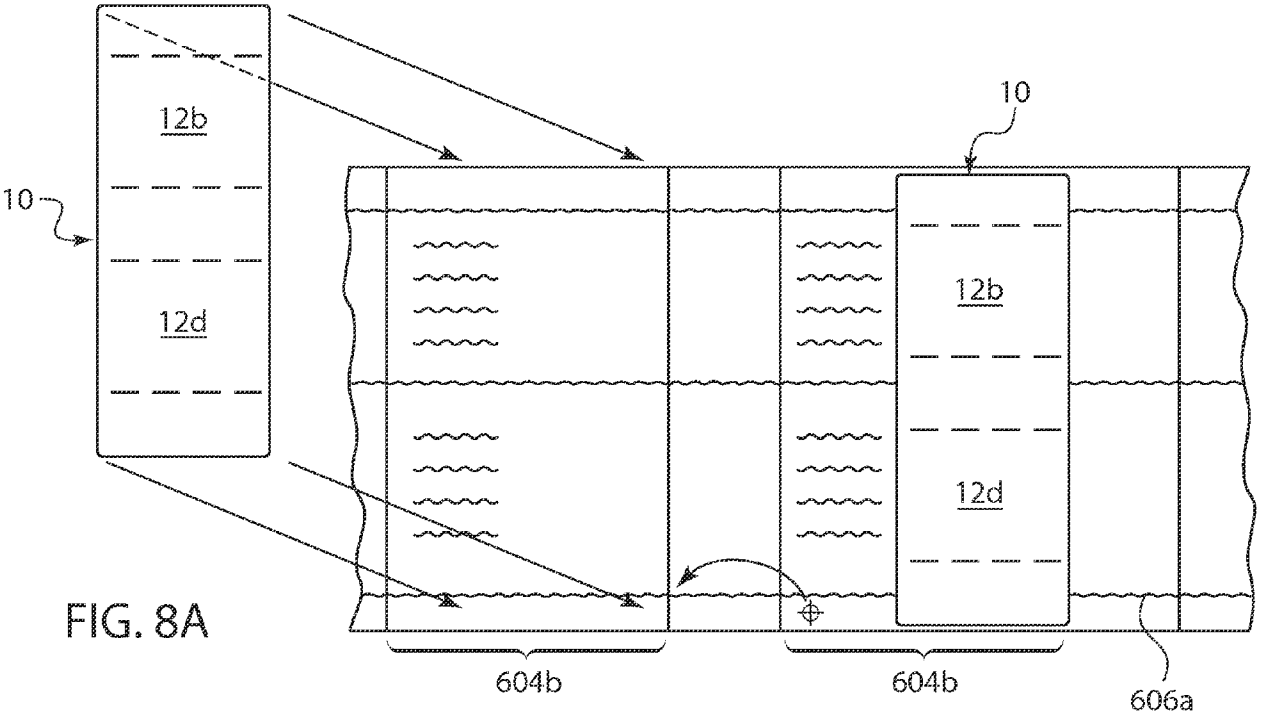
FIGS. 8A and 8B are top and side views of the book dispensing step of the method.
Figure 8B:
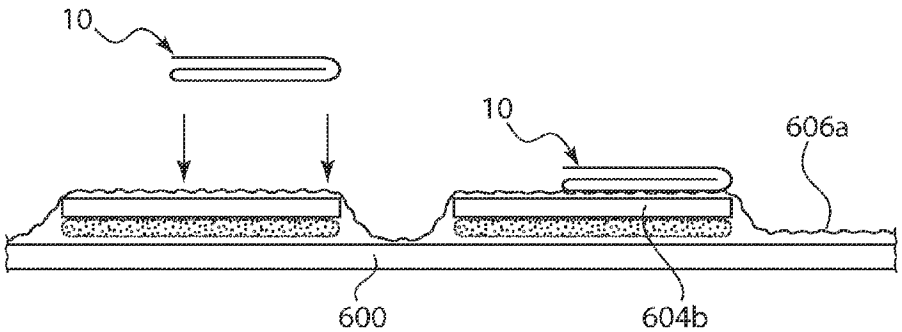

FIGS. 8A and 8B illustrate web 600 with three adhesive strips 606*a* running longitudinally along the web. The adhesive strips 606*a* are located in the waste rows (614*a, c* and *e*), passing across the cut sections 604*a* and the label sections 604*b*. The waste zones 14*a, c* and e of the books will align with the adhesive strips 606*a* to temporarily hold the book in place on the web. It should be noted that booklets 12*b* and 12*d* will not be adhered to the web. On the right label section 604*b*, a book 10 has been adhered in place along the right edge of label section 604*b*. The left side of the drawings show a book 10 being aligned for placement on to the next available label section 604*b*. This process allows a two-up or multi-up booklets to be placed on the web in one step.

Next the web with adhered books passes to a laminating station 640 where a continuous laminate having a similar width to the web, is fed from a laminate spool 640*b* and applied over the web and books. The laminate is may be opaque, translucent or transparent. If an opaque laminate is used, it may be pre-printed with indicia. In such a case, the laminate would need to be applied to the label section and book in registration. In a preferred embodiment the laminate is transparent without indicia. Accordingly, the indicia 602*a* and any printing on the upper facing surface of the book can be seen through the laminate. The laminate has a lower surface covered with adhesive and protected by a release liner. The release liner is peeled away and discarded as the laminate dispenses off the laminate spool. A press roller 600*c* insures that the laminate is closely adhered to the web as it encounters the bumps going from the flat web to the books adhered to the label sections.

Suitable laminate includes facestock between 0.8 to 1 mil thick coated with adhesive disposed on a liner. Suitable laminates are available from Avery Dennison sold under the tradename Fasson®. For example, Avery Dennison supplies 0.8 mil polypropylene facestock coated with clear, permanent acrylic adhesive; and 1 mil clear printed—treated polyester coated with S8020 clear, permanent acrylic adhesive disposed on 40# bleached white glassine liner. The preferred laminate is the latter 1 mil clear printed—treated polyester coated with S8020 clear, permanent acrylic adhesive disposed on 40# bleached white glassine liner.

Next the laminated web passes through a second die cutting station 650 where a die cutter 650*a* selectively cuts through portions of the laminate, book and label section 604*b*. The waste laminate with attached waste zones 14 from book 10 and attached label sections pass a guide roller 650*b* and on to a laminate take up reel 650*c*. More specifically, the die cutter 650 may consist of rectangular cutting dies. The cutting dies are configured to cut through the laminate on the left and right sides of each label. On the left side, the laminate is cut to be coextensive with the left side of the label section 604*b*. In other words, the label section and laminate end along the same line to collectively form the left edge of the completed label.

Figure 9A:
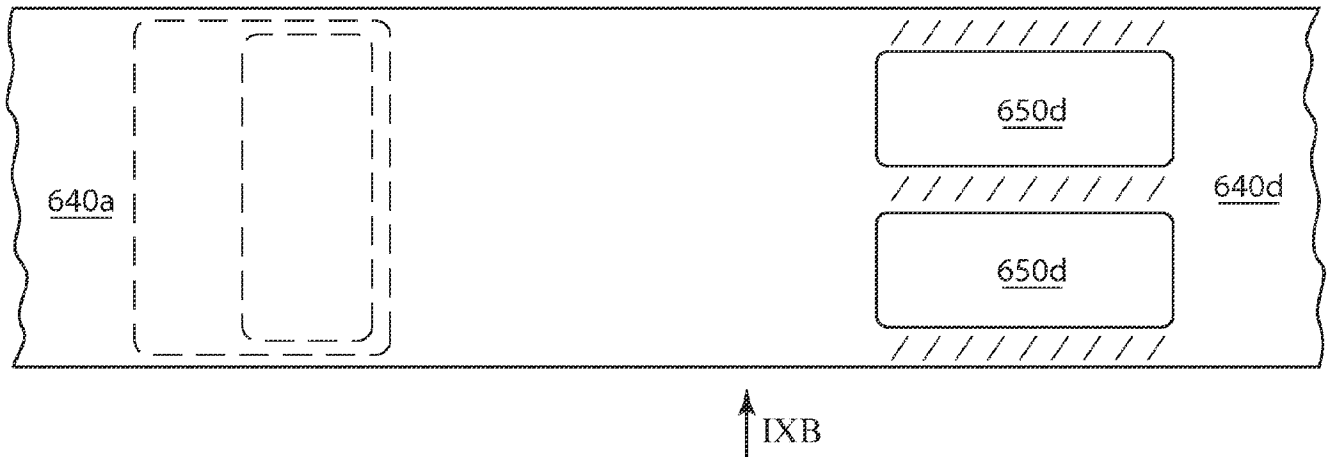
FIGS. 9A and 9B are top and side views of the laminating and second die cutting steps.
Figure 9B:
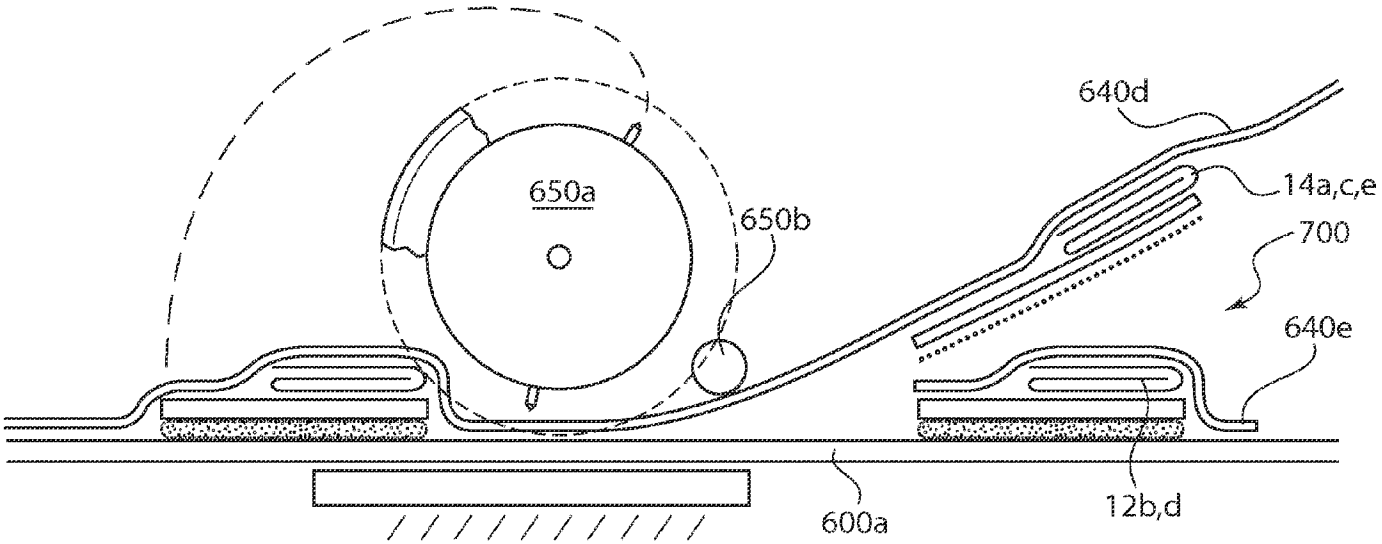

FIG. 9B shows a side view of the right blade of the rectangle in approximately the 6 o'clock position, and the left blade in approximately the 1 o'clock position. A section of the bottom blade is shown in approximately the 9 o'clock to 11 o'clock position. The remainder of the bottom blade is shown in dotted line for the sake of clarity. The top blade is not shown in the view, as it would be located behind the bottom blade. The bottom and top blades continue from the right blade in the 6 o'clock position to the left blade in the 1 o'clock position, thus forming the rectangular cutting die.

Above and below each label, the cutting dies slice the laminate, books and labels. By simultaneously slicing the laminate, books and labels, the longitudinal edges of the finished labels have a clean uniform edge. The cutting dies do not cut the web at any point.

The right side of FIG. 9A shows the waste laminate having rectangular window cut-outs 650*d* therethrough. Each window corresponds with a section of laminate that is left behind which covers the booklets and labels. Also shown on the right side of FIG. 9A in cross-hatching, is the waste zones 14*a, c* and *e* of the book (adhered to the laminate) that are removed with the waste laminate. Below that is the label section 604*b* (adhered to the waste zones of the book) that are also removed with the waste laminate. In other words, all the material in waste rows 614 are removed down to the release liner 600*a*. It should be noted that any folds in the top and/or bottom of the book [for example 36*f*(*i*) and 36*f*(*ii*)] will be removed from the web with the waste laminate 640*d*. The left side of FIG. 9A shows the laminate before it enters the second die cutting station 650. The book and label section are shown in dotted line underneath the laminate.

In FIG. 9B the completed label 700 is shown remaining on the release liner 600*a* after the die cut waste laminate 640*d* is removed. Finally, the web enters the web and label take up station 660. The web carrying the competed labels pass by web takeup guide roller 660*b* and are wound on web and label take up spool 660*a*.

Figure 10:
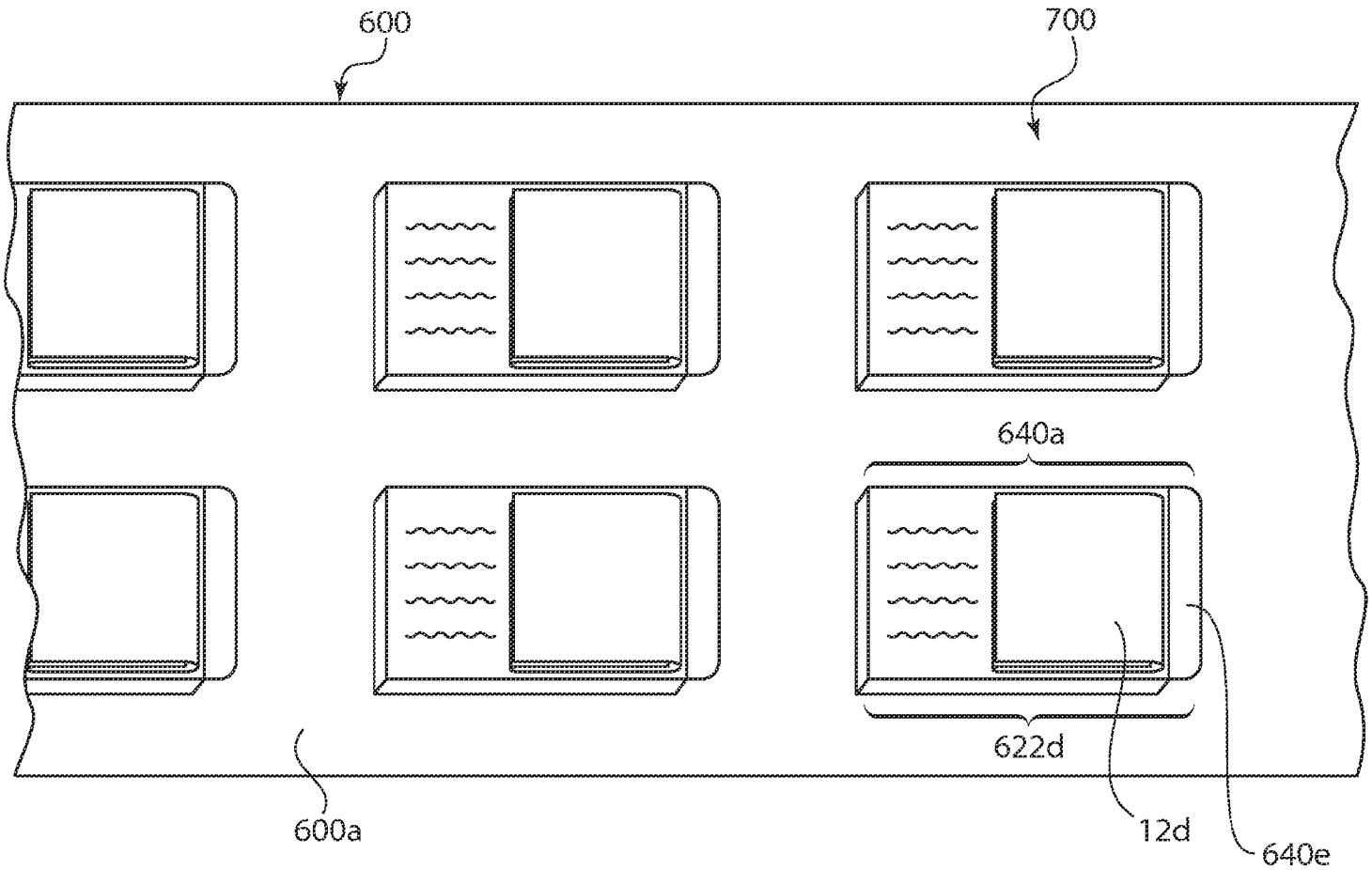
FIG. 10 is a top view of the web with completed labels.

In FIG. 10 the web 600 with completed labels 700 in a two-up configuration is shown in a top view. While a description will be given of the label in the right bottom corner, such description applies to all labels on the web. The D label 622*d* is shown with an exaggerated thickness to illustrate that the remaining sections of paper 600*b* have now been removed from the release liner 600*a* of web 600. The 12*d* booklet is adhered to the right side of label 622*d*. The remaining laminate 640 overlies labels 622*d* and extends further off the right side thereof to form laminate tab 640*e*. Laminate 640*a* is adhered to the exposed (left) portion of label 622*d* and is adhered to booklet 12*d*. The web may be slit in between the two labels, and each row of labels may be wound onto individual spools, providing several one-up label rolls.

FIGS. 8A, 8B, 9B show the right edge of book 10 aligned with the right edge of label section 604*b*. In an alternate embodiment the right edge of book 10 is spaced from the right edge of label section 604*b* to create a label tab. The label tab can be unitary with label section 604*b*, or a perforation can be provided between the label tab and label section 604*b*. The perforations can be formed within the first die cutting station 604. This label tab would extend underneath laminate tab 640*e*, that is the label tab would reside between laminate tab 640*e* and release liner 600*a*. According to this embodiment, the laminate tab 640*e* would be peeled from and re-adhered to the label tab, rather than the plastic bottle 800 (as shown in FIGS. 11A-C). If the label tab is perforated, it can be removed if the user prefers to have the laminate tab adhere to the container.

As described above, the first die cutting station 604 removed a cut section 604*a* of label in the area where laminate tab 640*e* would subsequently be formed. The paper 600*b* is smaller than laminate 640*a*. Since the laminate covers the entire web, and sections of paper which are to be omitted have to be die cut and removed before the laminate is applies. When the completed label is mounted on a container, the laminate tab can adhere directly to the container. If the laminate tab is to be formed onto the label, then first die cutting station can be eliminated with all die cutting and removing of waste laminate, book waste zones, and label paper occurring at the second die cutting station 650. In other words, the final shape of the laminate 640*a* and paper 600*b* would be the same and could be cut with a single die cutting station. The window cut-out 650*d* leaves behind the laminate tab 640*e*. If the first die cutting station was omitted, there would be paper 600*b* underneath the laminate tab.

The completed labels 700 from the bottom right of FIG. 9B and from FIG. 10 are peeled off the release liner and the label 622*d* is adhered to a container. FIG. 11A shows label 622*d* adhered to a cylindrical plastic bottle. The section of overlaminate where it transitions from label 622*d* to booklet 12*d* forms a hinge 700*a*. The hinge holds booklet 12*d* so that label 622*d* can freely conform to any radius container. In other words, label 622*d* can be adhered to the container without interference from the multiple pages of booklet 12*d*.

The web may wrap around a peel edge to release the completed label. As the label begins to separate from the web, a bottle is introduced. A roller 810 rotates clockwise while pressed against the bottle which rotates counter-clockwise. As the label is progressively adhered the pages within the booklet can shift and slide without effecting the smooth application of the label to the curved surface. Often in prior art booklet labels, the booklet is adhered to the label. This arrangement ties the overlaminate, booklet and label together. When this ensemble has many pages or bends around a small radius, the outer pages need to travel a further distance than the inner pages. Since all components are tied together, the ensemble will crease. According to the invention, the label can adhere to the container while the booklet and laminate are free to independently conform to the containers radius. Thus, the booklet and label are being pressed against the container at the same time, but are free to shift and slide without interference from the other.

After label 622*d* is completed adhered, the roller then arrives at the laminate tab 640*e*. The laminate tab wraps the booklet around the bottle and adheres to the bottle in a location that is totally independent from the label, as shown in FIG. 11B. Accordingly, one label configuration can be used on bottles with different radii. In addition, booklets of different styles, sizes and thicknesses can be used in a standard manufacturing set up. The laminate tab is self adjusting to enclose booklets of any thickness and securely hold them closed until needed. Thus, the laminate tab can adhere to the container closer or farther from the label.

The bottle with enclosed booklet as shown in FIG. 11B is ready to be packaged, shipped and sold. When the booklet needs to be accessed, the laminate tab 640*e* is peeled away from the bottle, pivoting at hinge 700*a* to carry the booklet away from the bottle, to a configuration shown in FIG. 11A. If the laminate tab is large or uses very strong adhesive, it may be desirable to reduce the holding strength to facilitate peeling the tab from the bottle. For this purpose, stripes of release material may be printed on the tab. The print area can be adjusted to determine how much adhesive will remain on the tab, thereby controlling the adhesive strength. The booklet can be unfolded at the two fold locations 10*x*(*ii*) and 10*x*(*i*). The user is presented with 6 or more pages of information, with all pages connected together at spine 10*d*. For certain applications, perforations may be provided. For example, a portion of the front page may be ripped off at perforation 50*p*(*i*). An entire page, e.g. the back page, may be ripped off at perforation 50*p*(*ii*).

While various forms of books and booklets have been shown and described, it should be understood that additional configurations may be provided within the scope of the application. For example, books with a greater number of pages may be provided. Books having two or more booklets contained therein may be included. Books with different fold locations and directions may be provided. In addition, several embodiments have been shown and described for a manufacturing process. Additional steps, or steps executed in different order are included within the scope of the invention. For example, adhesive and the release liner can be applied to the web before or after the labels are printed.

Having described preferred embodiments for books, booklets, folds, processes, apparatus and systems used therein for manufacturing extended content booklet labels (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A method for manufacturing an instructional booklet that folds away from a substrate comprising the steps of:

providing a multi-up book having two or more booklets and a waste zone that share a common spine;

adhering the waste zone to a substrate that is larger than the booklets; and applying an overlaminate to secure the multi-up book to the substrate, wherein the area between the booklets and the substrate is devoid of adhesive.

2. The method of claim 1, wherein said adhering step comprises:

printing adhesive on to one of the susbstrate and multi-up book in a location that only contacts the waste zone when the multi-up book is disposed on to the substrate.

3. The method of claim 1, wherein following the applying step, the method further comprises the step of:

simultaneously cutting through the overlaminate, multi-up book and substrate to eliminate the waste zone and form two or more overlaminate panels with each overlaminate panel corresponding to one booklet so that each overlaminate panel hingedly attaches a corresponding booklet to the substrate, thereby forming an instructional booklet that folds away from a substrate.

4. The method of claim 2, wherein the lack of adhesive between the booklet and the substrate allows the substrate to bend without interference from the booklet.

5. The method of claim 3, wherein the substrate is a continuous web having a longitudinal feed direction.

6. The method of claim 5, wherein prior to the adhering step the method further includes the steps of:

removing a strip of substrate to form a leading edge; and registering the multi-up book with the substrate so that a front edge of each booklet is aligned with the leading edge of the substrate.

7. The method of claim 6, wherein prior to said adhering step the method additionally includes the steps of:

printing indicia on the substrate in a location remote from the leading edge; and registering the multi-up book with the substrate so that a back edge of each booklet is spaced from the printed indicia.

8. The method of claim 5, wherein the substrate includes:

a top layer including a top surface devoid of adhesive and a bottom surface covered with adhesive, and a bottom layer comprising a release liner, wherein the bottom surface is adhered to the release liner.

9. The method of claim 8, wherein the simultaneous cutting step provides two or more multi-up labels, with each label having a booklet overlaminated to a substrate with adhesive on its bottom surface for securing to a container.

10. The method of claim 5, wherein the common spine is oriented perpendicular to the longitudinal feed direction.

11. The method of claim 8, wherein the simultaneous cutting step comprises slitting the overlaminate, multi-up book and substrate in a direction parallel to the longitudinal feed direction.

12. The method of claim 6, wherein the simultaneous cutting step comprises slitting the substrate to intersect the leading edge.

13. The method of claim 7, wherein the simultaneous cutting step comprises severing at least one of the substrate and overlaminate in a direction perpendicular to the longitudinal feed direction.

14. The method of claim 10, wherein the simultaneous cutting step comprises severing the back edge of the substrate and overlaminate in a direction perpendicular to the longitudinal feed direction to intersect the longitudinally extending slits.

15. The method of claim 10, wherein the simultaneous cutting step comprises severing the overlaminate (i) in a location spaced from the leading edge of the substrate and the front edge of the booklet to form an overhanging tab, and (ii) in a direction perpendicular to the longitudinal feed direction to intersect the longitudinally extending slits.

16. The method of claim 1, wherein the overlaminate includes a bottom surface covered with adhesive for adhering the multi-up book to the substrate.

17. The method of claim 16, wherein the overlaminate includes a tab that extends beyond the booklet and substrate adapted to removably adhere to a container.

18. The method of claim 1, wherein a waste zone is present in between each pair of adjacent booklets.

19. The method of claim 18, wherein a top edge of the multi-up booklet includes a top waste zone, wherein the top waste zone is adjacent the top booklet.

20. The method of claim 18, wherein a bottom edge of the multi-up booklet includes a bottom waste zone, wherein the bottom waste zone is adjacent the bottom booklet.

21. The method of claim 1, wherein the multi-up book has free ends opposite the spine, wherein the free ends are folded twice over towards spine to enclose the free ends within the book.

22. The method of claim 21, wherein the free ends are folded over twice to form three approximately equal size panels.

23. The method of claim 21, wherein the free ends are folded over twice to form three panels of different sizes.

24. The method of claim 23, wherein the three panels comprise:

a first panel adjacent the free ends which is centrally located within the multi-up book, a second panel adjacent the spine, and a middle panel extending between the first and second panels, wherein the middle panel is longer than said first panel and shorter than said second panel.

25. The method of claim 24, wherein the first and middle panels form a ramp up on one side of the multi-up book leading to the central portion of the mutli-up book which includes the first, second and middle panels, and wherein the second panel forms a ramp down on the other side of the multi-up book leading from the central portion of the multi-up book.

26. The method of claim 25, wherein the ramp up includes two panels, and wherein the central portion includes three panels, and wherein the ramp down includes one panel.

27. The method of claim 3, wherein following said simultaneous cutting step, the method further includes adhering the instructional booklet and substrate to a container, wherein the substrate and booklet are free to shift and slide with respect to each other and without interference from the other due to the lack of adhesive binding them together.

28. The method of claim 1, wherein the multi-up book is selected from the group consisting of:

one sheet folded in half to form a spine with a front cover and a back cover;

one sheet folded in half with adhesive, then cross folded to form a spine with a front cover, a back cover and two internal sheets;

one sheet accordion folded with adhesive then folded in half to form a spine with a front cover, a back cover and internal sheets;

one sheet folded in half with additional pages adhered inside to form a spine with a front cover, a back cover and internal sheets;

multiple sheets folded in half and nested with spines adhered; and multiple sheets folded in half and stacked with spines adhered.

* * * * *